US008036584B2

(12) United States Patent
Shiozawa et al.

(10) Patent No.: US 8,036,584 B2
(45) Date of Patent: Oct. 11, 2011

(54) IMAGE FORMATION SYSTEM, SMOOTHING APPARATUS, AND IMAGE FORMING METHOD

(75) Inventors: Motohide Shiozawa, Abiko (JP); Jiro Ishiduka, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/160,377

(22) PCT Filed: Sep. 28, 2007

(86) PCT No.: PCT/JP2007/069521

§ 371 (c)(1),
(2), (4) Date: Jul. 9, 2008

(87) PCT Pub. No.: WO2008/041758

PCT Pub. Date: Apr. 10, 2008

(65) Prior Publication Data

US 2010/0221048 A1 Sep. 2, 2010

(30) Foreign Application Priority Data

Sep. 29, 2006 (JP) ..... 2006-267724

(51) Int. Cl.
*G03G 15/20* (2006.01)

(52) U.S. Cl. ..... 399/341

(58) Field of Classification Search ..... 399/68, 399/329, 341, 342

See application file for complete search history.

(56) References Cited

U.S. PATENT DOCUMENTS

| | | | | |
|---|---|---|---|---|
| 6,026,268 | A | 2/2000 | Shiozawa et al. | 399/297 |
| 6,049,681 | A | 4/2000 | Shiozawa et al. | 399/46 |
| 7,057,631 | B2 | 6/2006 | Nakamura et al. | 347/115 |
| 7,596,349 | B2 * | 9/2009 | Ishiduka | 399/341 |
| 2006/0133836 | A1 | 6/2006 | Nakayama | 399/68 |
| 2006/0291927 | A1 | 12/2006 | Roof et al. | 399/341 |
| 2007/0071524 | A1 | 3/2007 | Nakamura | 399/341 |

FOREIGN PATENT DOCUMENTS

| | | |
|---|---|---|
| EP | 1 403 724 | 3/2004 |
| JP | 4-216580 | 8/1992 |
| JP | 4-362679 | 12/1992 |
| JP | 2007-102194 | 4/2007 |

OTHER PUBLICATIONS

International Search Report and Written Opinion in PCT/JP2007/069521.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming system includes image forming means for forming toner images on toner receiving resin layers of respective sides of a recording material; fixing means for heat fixing the toner images on the recording material in a fixing nip; and smoothing means for smoothing the toner receiving resin layers of the recording material having the toner images formed by the fixing means; wherein the system is operable in an image formation mode in which the toner images formed on the respective sides of the recording material are fixed by the fixing means sequentially, and then the toner receiving resin layers of the recording material are smoothed by the smoothing means sequentially.

6 Claims, 13 Drawing Sheets

IMAGE FORMATION SYSTEM, SMOOTHING APPARATUS, AND IMAGE FORMING METHOD

TECHNICAL FIELD

The present invention relates to the image formation system, smoothing apparatus, and image forming method for a copying machine, a printer, a facsimile machine, a multifunction apparatus capable of performing two or more of the functions of the preceding apparatuses, etc.

BACKGROUND ART

An image forming apparatus employing an electrophotographic image forming method has long been widely known. Not only various electrophotographic black-and-white image forming apparatuses, but also, various electrophotographic full-color image forming apparatuses have been commercialized. As an image forming apparatus has come to be widely used in various fields, the level of quality at which an image forming apparatus is required to form an image is becoming higher and higher.

More specifically, it has been desired to continuously improve an image forming apparatus in terms of the level of glossiness at which it is capable of forming a print (an image). Glossiness is one of the print (image) properties which gives a print (image) an impression of higher quality. Further, one of the primary factors which affects the glossiness of a print is the smoothness of the image bearing surface of a print.

As the means for accommodating the above described need, an apparatus has been proposed, in Japanese Laid-open Patent Applications H04-216580 and H04-362679, which yields a highly glossy print (image) by using a sheet of recording medium whose surface layer (toner reception layer) is formed of a transparent resin, and embedding a toner image into the surface layer, that is, the transparent layer formed of the transparent thermoplastic resin (this type of recording medium hereafter may be referred to as resinous medium).

In this apparatus, after the formation of a toner image on the transparent resin layer, the toner image is fixed by a fixing device. Then, the transparent resin layer, and the toner image thereon, are thermally melted with the highly glossy belt of a smoothing apparatus. Thereafter, while the resinous recording medium is conveyed through the smoothing apparatus, with the transparent resin layer in contact with the highly glossy belt, the resinous medium is cooled by a cooling apparatus. Then, the resinous medium is separated from the belt. Thus, after the separation of the resinous medium from the belt, the surface of the resinous medium, which is bearing the toner image, is as smooth as the highly glossy surface of the belt. Incidentally, the reason for cooling the resinous medium before separating it from the belt is to preventing the smoothed surface of the resinous medium from being rendered uneven again, by preventing the toner and the resinous layer of the resinous medium from offsetting onto the fixation roller.

Sometimes, it is required to produce a highly glossy two-sided print, that is, a highly glossy print having an image on both its front and back surfaces. In such cases, recording medium having a transparent resin layer on both of its two surfaces is used.

However, this method of yielding a highly glossy two-sided print by employing recording medium having a transparent resin layer on both of its surfaces sometimes suffers from the following problems:

That is, when an image is formed on both surfaces of a sheet of resinous recording medium having a transparent resinous layer on both of its surfaces, through the first step in which an image is transferred onto one (first) of the two surfaces of the resinous recording medium, fixed, and smoothed, and the second step in which another image is transferred onto the other surface (second) of the resinous recording medium, fixed, and smoothed, the smoothed first surface of the medium becomes unsmooth during the step; one of the two surfaces of the finished highly glossy two-sided print is not as glossy as desired.

This problem seems to occur for the following reason. That is, a fixing device in according with the prior art separates recording medium from the fixation belt (smoothing belt) while the recording medium is still hot; in other words, it does not allow the recording medium to cool before it separates the recording medium from the fixation belt (smoothing belt). Therefore, the smoothed first surface of the recording medium becomes unsmooth while the image on the second surface is fixed. Thus, the resultant unevenness of the first surface of the highly glossy two-sided print made with the above described two-sided resinous recording medium is more conspicuous when a fixing apparatus which is relatively high in fixation temperature is used.

Further, an image is formed on both surfaces of a two-sided resinous recording medium through the above described image formation sequence, each sheet of two-sided resinous recording medium is conveyed through the fixing apparatus—the smoothing apparatus—the fixing apparatus—the smoothing apparatus. Therefore, it is possible that the first surface, that is, the smoothed surface, of the two-sided resinous recording medium will be scarred by the pairs of conveyance rollers and pairs of conveyance guides disposed along the recording medium conveyance passage. This is another reason why the first surface side of a highly glossy two-sided print produced using an image formation method in accordance with the prior art is likely to be inferior in glossiness.

DISCLOSURE OF THE INVENTION

The primary object of the present invention is to produce a highly glossy two-sided print using a sheet of recording medium having a toner reception resin layer on both of its surfaces.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the present invention will be concretely described with reference to the preferred embodiments of the present invention. Incidentally, the following embodiments of the present invention are some of the examples of the most preferable embodiments of the present invention, and are not intended to limit the present invention in scope.

Embodiment 1

Figure 1:
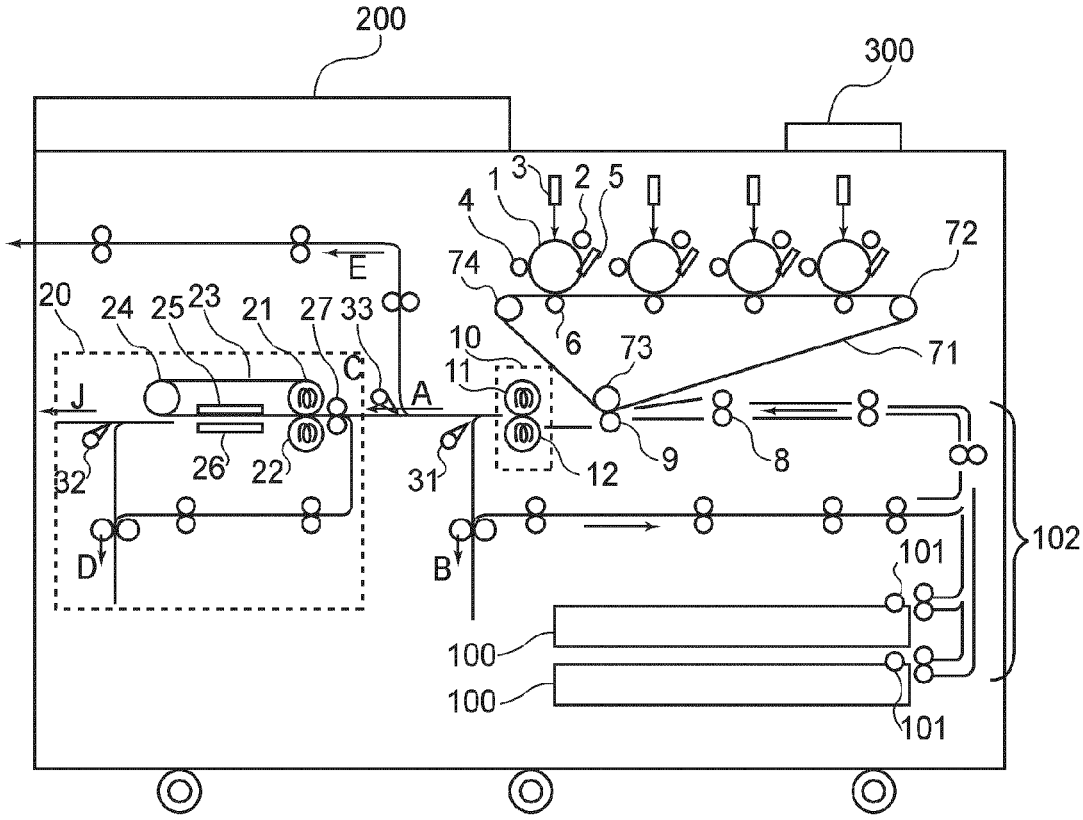
FIG. 1 is a schematic sectional view of a typical image forming apparatus compatible with the present invention, showing the general structure of the apparatus.

FIG. 1 is a schematic sectional view of the image formation system in the first preferred embodiment of the present invention. This image forming system is a multifunction color image forming apparatus, which is capable of functioning as a copying machine, as well as an ordinary printing apparatus. It employs an intermediary transferring member.

The image forming apparatus in this embodiment has a primary section (image forming apparatus proper) and a subordinate section (smoothing apparatus). The primary section has an image forming means and a fixing means, which will be described later, whereas the subordinate section has a smoothing apparatus and a recording medium overturning passage, which also will be described later. The image formation system is structured so that the subordinate section can be attached to, or removed from, the primary section, as necessary, by an operator. In other words, the subordinate section is a so-called optional unit, and the primary section is a stand-alone image forming apparatus, that is, an image forming apparatus capable of forming an image by itself on a sheet of recording medium, such as a sheet of ordinary paper.

Incidentally, the image formation system is structured so that the image forming means, fixing means, and smoothing apparatus are contained in the same (single) housing.

(Image Forming Means)

First, the image forming means (engine portion) of the image forming apparatus, which is for forming a toner image on recording medium, such as ordinary paper, OHP sheet, resinous recording medium (which will be described later), will be described regarding its structure. The image forming system is made up of multiple image forming devices which will be described next.

The primary section has an original reading apparatus 200 for reading (obtaining) the pictorial information of an original placed on (in) the reading apparatus 200. The original reading apparatus 200 is on top of the primary section. The pictorial information of the original, which was read by the original reading apparatus 200, is processed for image formation. An exposing apparatus, which will be described later, is controlled according to the data obtained by processing the pictorial information obtained by the original reading apparatus 200.

The primary section is also provided with a control panel 300 which is to be used by an operator to set various values for controlling the image forming apparatus. The control panel 300 is located next to the original reading apparatus 200. It is through this control panel 300 that selection is made among various image formation modes, which will be described later, and also, various commands are inputted. A controller 400 (FIG. 13) is a controlling apparatus which controls the image forming devices, fixing device, and smoothing apparatus (which will be described later), based on the information regarding the selected image formation mode and the inputted commands.

The primary section is also provided with four image formation stations Y, M, C, and K, which are located in the top portion of the primary section, being horizontally juxtaposed in parallel, and which form yellow, magenta, cyan, and black toner images, respectively. The four image formation stations are roughly the same in structure, although they are different in the color of the toner, as developer, which they use.

Hereafter, the image formation station Y will be described in detail. The image formations M, C, and K are virtually the same in description as the image formation station Y.

The image formation station Y is provided with a photosensitive member 1 as an image bearing member (which is in the form of a drum, and therefore, will be hereafter referred to as photosensitive drum). The photosensitive drum 1 is rotatably supported in the image formation station Y. The image formation station Y is also provided with a charge roller as a charging means, an exposing unit 3 as a drum exposing means, a developing device 4 as a developing means, a primary transfer roller 6 as a primary transferring means, and a cleaner 5 as a cleaning means, which are arranged in the adjacencies of the peripheral surface of the photosensitive drum 1, in a manner to surround the peripheral surface of the photosensitive drum 1.

The primary section is also provided with an intermediary transfer belt 71 as an intermediary transfer medium, which is circularly movable in contact with the peripheral surface of the photosensitive drum 1. The intermediary transfer belt 71 is supported by a follower roller 72, a belt backing roller 73, and a driver roller 74, by being stretched around them. The driver roller 74 is driven by a motor. Further, the primary section is provided with primary transfer rollers 6, each of which is positioned so that it is pressed against the corresponding photosensitive drum 1, with the intermediary transfer belt 71 pinched between the transfer roller 6 and photosensitive drum 1. The follower roller 72 functions as a tension roller, in addition to functioning as intermediary transfer belt supporting roller, and provides the intermediary transfer belt 71 with a preset amount of tension. Further, the primary section is structured so that secondary transfer bias is applied to the belt backing roller 73 from a high voltage power source.

The primary section is also provided with cassettes 100 for holding recording medium. The cassettes 100 are located below the intermediary transfer belt 71. The primary section of the image forming apparatus in this embodiment is provided with two cassettes 100, which are different in the specification of the recording medium to be held therein.

Each cassette 100 is provided with a pickup roller 101, which is for feeding the sheets of recording medium in the cassette 100 into the primary section while separating them one by one.

After being fed into the primary section by the pickup roller 101, each sheet of recording medium is conveyed to a pair of registration rollers 8 by way of multiple pairs of conveyance rollers 102. This pair of registration rollers 8 is assigned the function of controlling the timing with which each recording medium is released so that the timing with which a toner image on the intermediary transfer belt 71 enters the transfer station matches the timing with which the recording medium enters the transfer station.

Next, the image forming operation carried out by this image formation station will be described.

Each of the image forming devices of the image forming apparatus operates at a process speed which matches the process speed (peripheral velocity) of the photosensitive drum 1, which is approximately 130 mm/sec. Thus, the speed at which the exposing unit 3 scans the peripheral surface of the photosensitive drum 1 is set according to the process speed (peripheral velocity) of the photosensitive drum 1.

First, the peripheral surface of the photosensitive drum 1 is uniformly charged by the charge roller 2 while the photosensitive drum 1 is rotated in the counterclockwise direction of FIG. 1. Then, a beam of laser light is projected from the exposing unit 3 upon the uniformly charged peripheral surface of the photosensitive drum 1 while being modulated with picture signals. As a result, an electrostatic latent image is effected on the peripheral surface of the photosensitive drum 1. This electrostatic latent image is developed by the developing device 4 into a visible image; developer is adhered to the electrostatic latent image. Then, the toner image on the photosensitive drum 1 is transferred (primary transfer) onto the intermediary transfer belt 71 by the primary transfer bias applied to the primary transfer roller 6.

The above described steps up to the end of the development step are carried out in each image formation station. Therefore, four toner images different in color are transferred (primary transfer) in layers onto the intermediary transfer belt 71. That is, the yellow, magenta, cyan, and black toner images formed by the image formation stations Y, M, C, and K, respectively, are transferred in layers onto the intermediary transfer belt 71. As a result, a single full-color image is effected on the intermediary transfer belt 71.

Thereafter, secondary transfer bias is applied to the belt backup roller 73. As the second transfer bias is applied, the toner images on the intermediary transfer belt 71 are transferred together (secondary transfer) onto the sheet of recording medium introduced into the secondary transfer station.

After the transfer of the full-color image onto the recording medium, the recording medium is conveyed to a fixing apparatus 10, in which the toner images (full-color image) are fixed to the recording medium.

(Fixing Device)

The fixing device 10 is a fixing means located on the downstream side of the secondary transfer station in terms of the recording medium conveyance direction.

This fixing device 10 is made up of a fixation roller 11 as a fixing member, and a pressure roller 12 as a nip forming member (pressure applying member) which forms a fixation nip by being pressed upon the fixation roller 11. The total amount of the contact pressure between the fixation roller 11 and pressure roller 12 is 50 kg.

The fixation roller 11 has a laminar structure, and is made up of a metallic core, an elastic layer, and a toner release layer. The elastic layer and toner release layer are layered in the listed order around the peripheral surface of the metallic core. The metallic core is formed of Al, Fe, or the like. The elastic layer and toner release layer are formed of rubber and fluorinated resin, respectively. The metallic core is hollow, and a halogen heater as a heat source is disposed in the hollow of the metallic core. A heater other than the halogen heater may be employed as the heat source. For example, a so-called induction heater, that is, a heater based on electromagnetic induction, may be used as the heat source.

The fixation roller 11 is connected to a motor through a gear train, and is rotated by the driving force from this motor.

The structure of the pressure roller 12 is the same as that of the fixation roller 11. That is, the pressure roller 12 is made up of a metallic core, an elastic layer, and a toner release layer. The elastic layer and toner release layer are layered in the listed order around the peripheral surface of the metallic core. The elastic layer and toner release layer are formed of rubber and fluorinated resin, respectively. The metallic core is hollow, and a halogen heater as a heat source is disposed in the hollow of the metallic core. A heater other than the halogen heater may be employed as the heat source. For example, a so-called induction heater, that is, a heater based on electromagnetic induction, may be used as the heat source.

The fixing device 10 is structured so that the pressure roller 12 is rotated by the rotation of the fixation roller 11, and therefore, rotates with the fixation roller 11.

In the immediate adjacencies of the peripheral surface of the fixation roller 11 and the peripheral surface of the pressure roller 12, a pair of thermistors are disposed one for one as the means for detecting the temperature of the fixation roller 11 and pressure roller 12. The amount of the power supply to the halogen heaters in the fixation roller 11 and pressure roller 12, one for one, is controlled by a controller 400 in response to the outputs of the two thermistors. In this embodiment, the fixation temperature of the fixation roller 11 is set to 180° C., and the fixation temperature of the pressure roller 12 is set to 150° C. Thus, the temperatures of the two rollers 11 and 12 are controlled by the controlling apparatus so that they remain at the above-mentioned levels.

The fixing device 10 in this embodiment is structured so that it fixes the toner images on the recording medium conveyed from the second transfer station, to the recording medium by applying heat and pressure to the combination of the toner images and recording medium, in the fixation nip.

Further, the fixing device 10 is structured so that when the recording medium is sent out of the fixing device 10 (fixation nip), that is, when the recording medium is separated from the fixing device 10, the temperature of the recording medium is high (approximately 90-100° C.). That is, in this embodiment, the recording medium is separated from the fixing device 10 virtually at the same time as the recording medium comes out of the fixation nip (high temperature separation method).

Incidentally, described above was a fixing apparatus employing a pair of rollers. However, the present invention is also effectively applicable to a fixing apparatus employing a belt in place of the fixation roller or pressure roller.

(Resinous Recording Medium)

Figure 3:
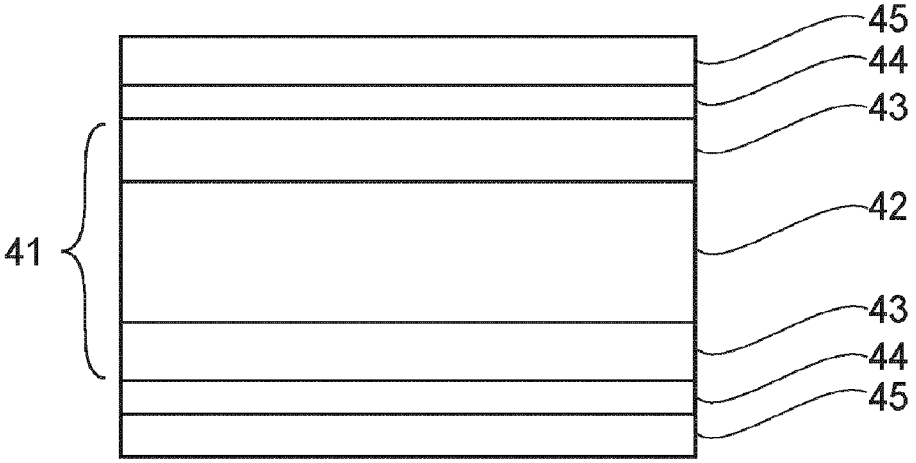
FIG. 3 is a schematic drawing for describing the laminar structure of the two-sided resinous recording medium.

Next, referring to FIG. 3, a sheet of recording medium having the toner reception resin layer (which hereafter will be referred to as toner reception layer) on both of its surfaces will be described (this recording medium hereafter will be referred to as two-sided resin medium). The two-sided resin medium is used in the two-sided image formation mode for producing a two-sided print which is highly glossy on both of its surfaces (photographic output mode). The resinous medium is used in various fields; it is used as a recording medium for photographs, pamphlets, flyers, pop-ups, display arts, etc. It is an ideal recording medium for outputting high quality prints.

Here, "toner reception layer" may be defined as the layer of resinous recording medium, which allows toner (toner image) to be embedded into the resinous recording medium during a smoothing operation. Further, when the toner reception layer is smoothed, it softens with toner, being therefore tolerant of toner. Therefore, it may be referred to as a "toner accommodating layer".

The two-sided resinous medium 41 in this embodiment is a so-called resin-coated paper, that is, such two-sided resinous medium that is made up of base paper 42, and two resin layers 43 coated or laminated on the two surfaces of the base paper 42. The substance used as the material for the two resin layers 43 is polyethylene resin.

The surface properties of the resin layer of the RC paper 41 affects the surface properties of a print produced using the RC paper 41. Therefore, the surfaces of the RC paper 41 are desired to be highly smoothly finished. In this embodiment, therefore, an intermediary layer 44 and a toner reception layer 45 are placed in layers on both surfaces of the base paper 42. Incidentally, the provision of the intermediary layer 44 is not mandatory.

The toner reception layer 45 is a transparent thermoplastic resin layer, and its thickness is in a range of 5-30 μm. In this embodiment, in order to enable the toner reception layer 45 to soften (melt) with toner when it is smoothed, polyester resin is used as the material for the toner reception layer 45. That is, it is desired that a transparent thermoplastic resin which is highly tolerant of toner is selected as the material for the toner reception layer 45. Incidentally, before the toner reception layer 45 in this embodiment is heated, it appears white. However, it becomes transparent as it is heated.

As the polyhydric alcohol and polyhydric carbonate, of which polyester resin used as the material for the toner reception layer, the following can be used:

As the polyhydric alcohol, it is possible to use ethylene glycol, propylene glycol, 1,4-butadiene diol, 3,3-butadiene diol, diethylene glycol, triethylene glycol, 1,5-pentadiol, 1,6-hexane diol. It is also possible to use neopentyl glycol, 1,4-cyclohexane dimethanol, dipropylene glycol, polyethylene glycol, polypropylene glycol, monomer made up of bisphenol A and olefin oxide, and the like.

As the polyhydric carbonate, it is possible to use maleic acid, maleic anhydride, fumaric acid, phthalic acid, terephthalic acid, isophthalic acid, malonic acid, succinic acid, glutaric acid, dodecyl succinic acid, n-octyl succinic acid, n-dodecyl succinic acid. It is also possible to use 1,2,4-benzene tricarbonic acid, 1,2,4-cyclohexane tricarbonic acid, 1,2,4-naphthalene tricarbonic acid, 1,2,5-hexane tricarbonic acid. Further, 1,3-dicarboxy-2-methyl-2-methylene carboxy propane (methylene carboxy)methane, 1,2,7,8-octane tetracarbonic acid, trimellitic acid, pyromellitic acid may be used. Moreover, lower alkylester formed of any of these acids may be used.

Incidentally, polyester resin of which the transparent toner reception layer is formed is synthesized through the polymerization of one or more of the abovementioned polyhydric alcohols, and one or more of the abovementioned polyhydric carbonic acids.

Further, the toner reception layer may contain pigment, releasing agent, conductive agent, etc., by the amount which does not reduce the toner reception layer in transparency. When the above-mentioned ingredients are added to the material for the toner reception layer, the overall amount by which they are added is desired to be such that the weight of the primary component of the resin layer is no less than 80% relative to the overall weight of the toner reception layer. Further, the material for the transparent resin layer is desired to be adjusted in composition so that the resultant transparent resin layer is no less than $8.0\times10^{8}\Omega$ in surface electrical resistance (20° C. in temperature and 85% in relative humidity).

The selection of the resinous medium does not need to be limited the above described one. That is, any resinous medium is usable as long as its surface layers are formed of thermoplastic material which melts when it is heated to a temperature close to the fixation temperature. In other words, the resinous medium does not need to be laminar to be usable with the image forming apparatus in this embodiment. Needless to say, it is acceptable to add additives, such as pigment, to the material for such resinous recording medium.

Thus, the glass transition temperature (Tg) of the resinous material for the toner reception layer is the same as that of toner, being therefore in a range of 40° C.-100° C., in order to ensure that during a smoothing operation carried out by the smoothing apparatus, which will be described later, the toner reception layer softens with the toner to allow the toner to be embedded into the toner reception layer. As the toner is embedded into the toner reception layer, the resinous medium, which is bearing the toner (toner image) becomes smooth across both of its surfaces, yielding therefore a highly glossy print.

Also in this embodiment, for the purpose of yielding a highly glossy print having an appearance of a photograph produced by silver salt photography. From the standpoint of the recording medium conveyance in an image forming apparatus, two-sided resinous recording medium, the overall basis weight of which is in a range of 100 g/m$^2$-300 g/m$^2$ is used as the two-sided resinous medium for this embodiment. However, it is preferred that the overall basis weight of the resinous medium is in a range of 170 g/m$^2$-250 g/m$^2$.

Further, single-sided resinous recording medium, that is, recording medium having only a single toner reception layer, may be used as the resinous medium for this embodiment. Single-sided resinous recording medium is made up of the base paper 42, and the resinous layer 43, which is on only one of the two surfaces of the base paper 42. Also in the case of single-sided resinous recording medium, the material for the resinous layer 43 is polyethylene, and is laminated or coated on only one of the two surfaces of the base paper 41. Incidentally, single-sided resinous recording medium may also be provided with the intermediary layer 44, which is placed on the base paper 42 before the resinous layer. Single-sided resinous recording medium is used in the single-side image formation mode for yielding a highly glossy print having an image only on one of its two surfaces. The single-sided highly glossy print and the mode for yielding it will be described later.

(Smoothing Apparatus)

In this embodiment, when the image forming apparatus is in the mode (photographic mode) for producing a highly glossy print, using the above described sheet of resinous medium, a highly glossy print is produced by smoothing resinous recording medium, across the surface(s) which is bearing an image, with the use of a smoothing apparatus. The smoothing apparatus in this embodiment is such a smoothing apparatus that separates resinous recording medium from its smoothing member after the cooling of the recording medium.

The smoothing apparatus 20 has a two-sided print formation passage (recording medium conveyance passage), in addition to a smoothing portion as a smoothing means (smoothing device). The two-sided print formation passage is a means for turning upside down a sheet of resinous medium after the resinous medium comes out of the smoothing portion, and then, introducing the sheet of resinous medium back into the smoothing portion. More specifically, referring to FIG. 1, the two-sided print formation passage is provided with a flapper 32 and multiple pairs of conveyance rollers. Its role is to reintroduce the sheet of resinous medium into the smoothing portion after the smoothing of one (first) of the two surfaces of the resinous medium, in order to smooth the other (second) surface of the resinous medium. It reintroduces the resinous medium into the smoothing portion, without allowing the resinous medium to pass the fixing device, after the smoothing of the first surface of the resinous medium.

The smoothing portion has a highly glossy endless belt 23 (first rotational member), a pressure roller 22 (second rotational member), and a pair of cooling apparatuses 25 and 26. The pressure roller 22 forms a nip against the belt 23.

The role of the belt 23 is to make the surface of a sheet of resinous medium, on which an image is present, as glossy as the highly glossy surface of the belt 23; the belt 23 is heated while being kept in contact with the surface of the resinous medium, on which an image is present. In this embodiment, therefore, an endless belt whose glossiness level (60° glossiness) is in a range of 60-100 is used as the belt 23. Incidentally, the glossiness level of a belt can be measured with the use of the method which will be described later. Further, the glossiness level of the belt 23 is optional; it may be selected according to the glossiness level at which an image forming apparatus is required to form an image.

In this embodiment, the material for the substrate of the belt 23 is a thermally curable resin such as polyimide. However, heat resistant resins other than polyimide, or metal, may be used as the material for the substrate of the belt 23. The belt 23 is made up of the substrate, and an elastic layer formed of silicon rubber on the substrate. Instead of silicon rubber, fluorinated rubber or the like may be used. Further, the silicon rubber layer is covered with a layer of fluorinated resin as a toner releasing layer.

If the thickness of the belt 23 is less than a certain value, the belt 23 is insufficient in strength to apply pressure to the toner reception layer to smooth the toner reception layer while embedding toner embed into the toner reception layer. On the other hand, if the thickness of the belt 23 is no more than a certain value, the amount of heat necessary to heat the belt 23 is excessive, making it possible that the toner may be insufficiently embedded into the toner reception layer. Therefore, a belt, the thickness of which is in a range of 100 μm-300 μm, is employed as the belt 23.

The belt 23 is suspended by a heat roller 21 and a tension roller 24 so that it can be circularly moved. In this embodiment, the heat roller 21 also bears the role of driving the belt 23.

The heat roller 21 is a hollow roller. It is made up of a metallic core formed of a metallic substance which is excellent in thermal conductivity, and a rubber layer, as an elastic layer, formed in a manner to wrap around the peripheral surface of the metallic core. To describe in more detail, the metallic core is a piece of hollow aluminum pipe, which is 44 mm in diameter and 5 mm in thickness. The rubber layer is formed of silicon rubber which is 50 degrees in hardness (JIS-A scale) and is 300 μm in thickness. In the hollow of the heat roller 21, a halogen heater is located as a heat source. As the heat source, a so-called IH heater, that is, a heater which generates heat by electromagnetic induction, may be employed in place of the halogen heater.

There is a thermistor as the means for detecting the temperature of the belt 23, which is located in the immediate adjacencies of the surface of the belt 23, which faces the heat roller 21. The amount of power supply to the halogen heater is varied by the controller 400 in response to the output of this thermistor so that the temperature of the belt 23 is kept at 130 degrees, in the area in which the belt 23 is in contact with the heat roller 21.

The smoothing apparatus 20 is designed so that recording medium is separated from the belt 23 by the curvature of the tension roller 24. Therefore, the tension roller 24 is positioned where recording medium is to be separated from the belt 23. That is, in this embodiment, the diameter of the tension roller 24 is set so that the recording medium is separated from the belt 23 by the combination of the resiliency of the recording medium itself and the curvature of the belt 23 (tension roller 24).

The pressure roller 22 is rotatably positioned in a manner to oppose the heat roller 21, with the belt 23 sandwiched between the two rollers 21 and 22. The smoothing apparatus 20 is designed so that the pressure roller 22 is rotated by the circular movement of the belt 23.

The pressure roller 22 is a hollow roller. It is made up of a metallic core formed of a metallic substance, and a rubber layer, as an elastic layer, formed in a manner to wrap around the peripheral surface of the metallic core. In this embodiment, a halogen heater is located as a heat source in the hollow of the pressure roller 22. As the heat source, a so-called IH heater, that is, a heater which generates heat by electromagnetic induction, may be employed in place of the halogen heater.

The pressure roller 22 is kept pressed against the heat roller 21 with the application of a total amount of pressure of 50 kg (490 N), with the presence of the belt 23 between the two rollers 21 and 22. That is, the pressure roller 22 is assigned the role of forming, between itself and the belt 23, a nip which is 5 mm in length in terms of the direction parallel to the recording medium conveyance direction.

There is a thermistor as the means for detecting the temperature of the pressure roller 22, which is located in the immediate adjacencies of the surface of the pressure roller 22. The amount of the power supply to the halogen heater is varied by the controller 400 in response to the output of this thermistor so that the temperature of the pressure roller 22 is kept at 90 degrees.

After being subjected to heat and pressure in the nip between the belt 23 and pressure roller 22, the recording medium is conveyed, while remaining in contact with the belt 23, to the area in which it is cooled by the cooling apparatuses 25 and 26. In this embodiment, the cooling apparatuses 25 and 26 are a pair of cooling fans, which cool the portion of the recording medium, which is in the cooling area. Each of the cooling apparatuses 25 and 26 is provided with a pair of ducts, that is, an inward duct and an outward duct, which are located on the inward and outward sides of the loop which the belt 23 forms. The cooling apparatuses 25 and 26 are structured so that the cooling air moves through their air ducts.

The cooling capacity of the cooling apparatuses 25 and 26 is set so that the toner reception layer and the toner will be cooled to their glass transition points by the time the resinous medium reaches the abovementioned separation location. Incidentally, in this embodiment, the primary resinous substance, of which the toner is formed, and the primary substance, of which the reception layer are formed, are the same. Therefore, the glass transition point of the toner is the same as that of the toner reception layer.

In other words, the smoothing apparatus in this embodiment is of the so-called low temperature separation type, which separates the resinous medium from the belt 23 after the temperature of the resinous medium falls to a temperature level which is substantially lower than the fixation temperature of the above described fixing device 10.

The selection of the cooling apparatus does not need to be limited to those described above. For example, cooling apparatuses designed so that recording medium is placed in contact with a heat pipe or a heat sink, which contains cooling medium, such as water, or a Peltier element, may be employed in place of as the cooling apparatuses 25 and 26. Further, the smoothing apparatus may be provided with a single cooling apparatus so that recording medium is cooling from only one side of the recording medium in terms of the thickness direction of the medium.

Next, the smoothing operation of the smooth apparatus 20 will be described.

After the fixation of the toner images to resinous medium, the resinous medium is introduced into the smoothing apparatus while its temperature is still remaining at roughly 80 degrees. As the resinous medium is introduced into the smoothing apparatus, the surface of the resinous medium, which has the toner images, is subjected to heat and pressure in the nip of the smoothing apparatus, so that the temperature of the resinous medium increases to a level, more specifically, roughly 110 degrees, which is high enough to exceed the glass transition temperature of the toner. Thus, the toner reception layer of the resinous medium, and the toner thereon, are softened (melted) together. As a result, the toner (toner images) becomes embedded in the toner reception layer.

Thereafter, the resinous medium is conveyed to the cooling area, while remaining in contact with the belt 23, and is cooled by the cooling apparatuses 25 and 26 so that its temperature falls to the glass transition temperature (Tg) of the toner, which is roughly 50 degrees. Thus, the surface of the resinous medium, which has the toner (toner images), conforms to the highly glossy (smooth) surface of the belt 23, becoming thereby smooth, and therefore, highly glossy, across the surface having the toner (toner images). Then, the resinous medium is sufficiently cooled, and is separated from the belt 23 by the combination of its own resiliency and the curvature of the belt 23 (tension roller 24). Therefore, it does not occur that the surface of the resinous medium, which has the toner (toner images), is made unsmooth by the offsetting of the toner and/or certain portions of the toner reception layer onto the belt 23.

After being subjected to the smoothing process described above, the resinous medium is discharged from the image forming apparatus, ending the sequence for forming an image on the sheet of resinous medium.

(Singe-Sided Image Formation Mode)

The image forming apparatus in this embodiment is capable of operating in two different single-sided image formation modes, that is, two different image formation modes in which a toner image is formed on only one of the two surfaces of recording medium. The image forming apparatus is designed so that either of the two single-sided image formation modes can be selected in response to the command given by an operator through the graphic control interface displayed on the visual monitor (liquid crystal display) of the control portion of the image forming apparatus. Incidentally, when an operator wants to use this image forming apparatus as an ordinary printer, commands, such as the abovementioned command for mode selection, are inputted to the image forming apparatus through a graphic printer driver interface, such as the one shown in FIG. 12, displayed on the display of the external device networked with the image forming apparatus.

One of the abovementioned two single-sided image formation modes is a normal (first) image formation mode, that is, a mode in which the toner image formed on one of the two surfaces of recording medium, such as a sheet of ordinary paper, is fixed, and then, the recording medium is immediately discharged from the apparatus main assembly. Hereafter, this single-sided image formation mode, that is, the mode in which a sheet of ordinary paper is used as recording medium, will be referred to as a normal ordinary output mode.

The other single-sided image formation mode is a special single-sided image formation mode, that is, a mode in which a toner image formed on the toner reception layer of a sheet of single-sided resinous medium is fixed; the recording medium is smoothed across the surface on which the toner is present; and the recording medium is discharged from the apparatus main assembly. Hereafter, this single-sided image formation mode, that is, a mode in which a sheet of single-sided resinous medium is used as recording medium, will be referred to as a photographic output mode. Incidentally, the two-sided image formation mode in which a sheet of two-sided resinous is used as recording medium will be also referred to as a photographic mode.

Figure 4:
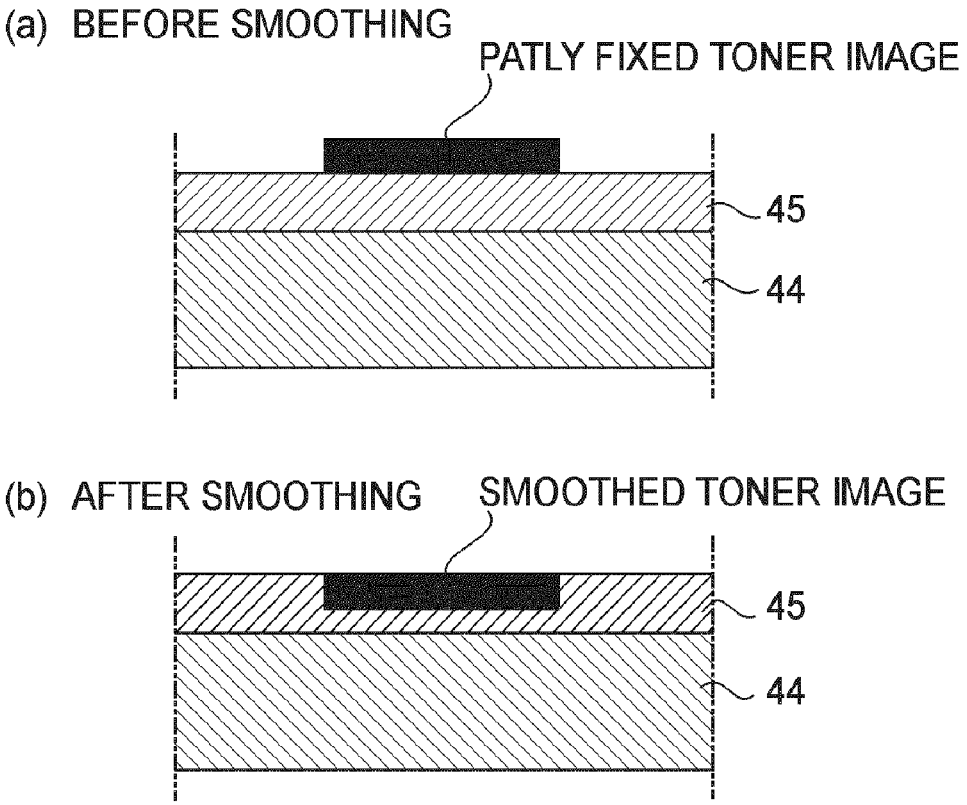
FIG. 4 is a schematic drawing for describing the states of the two-sided resinous recording medium prior to and after the surface flattening process.

Here, "fixation process" means such a process that is for fixing a toner image to the toner reception layer just enough to prevent the toner from offsetting to the conveyance rollers and the like while the recording medium is conveyed to the smoothing apparatus (FIG. 4(*a*)). Thus, the fixing process carried out in this single-sided image formation mode may be referred to as "temporarily fixing process". It is different from the fixation process in the normal single-sided fixation mode in terms of the condition and result of fixation.

Figure 13:
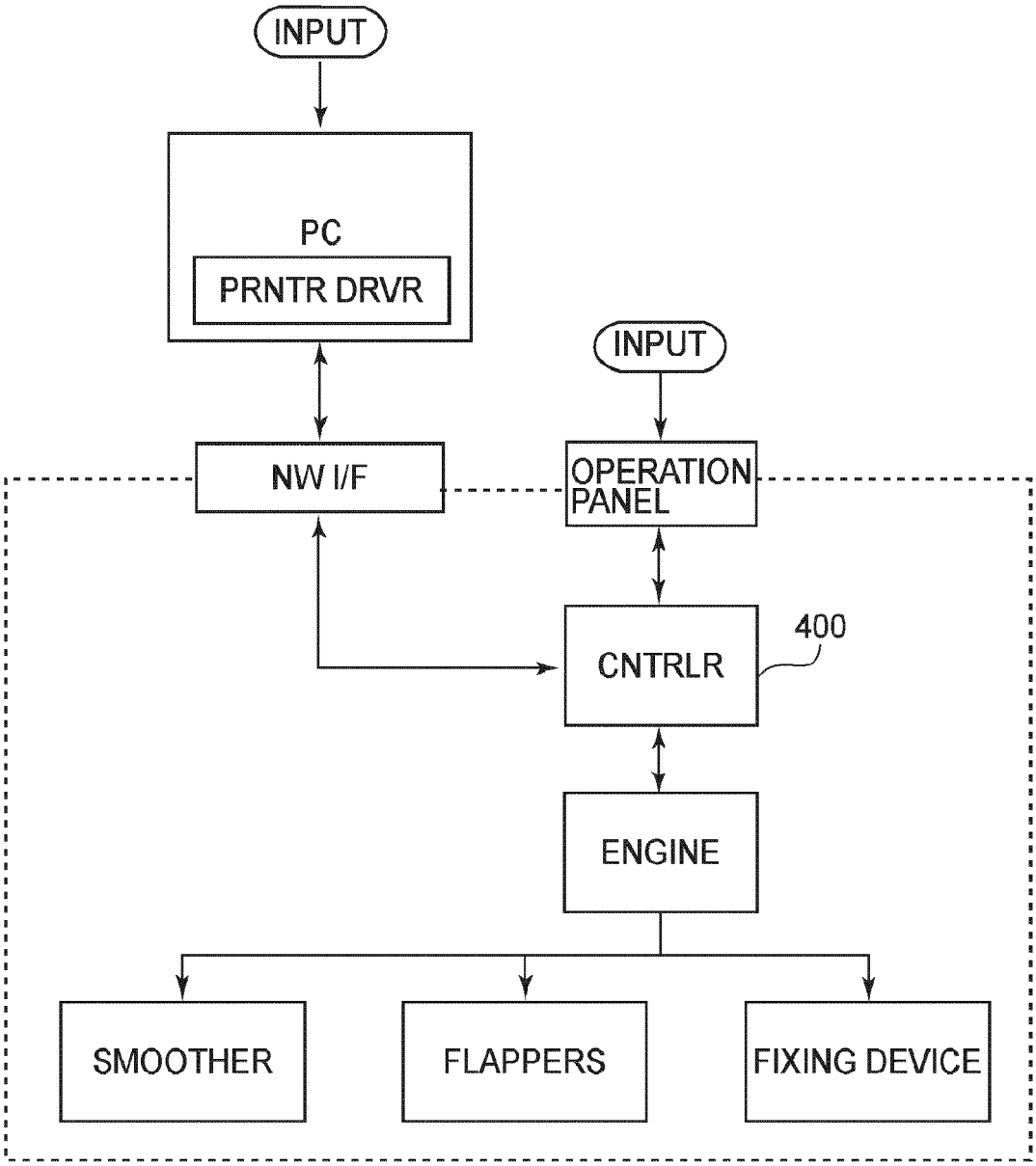
FIG. 13 is a block diagram of the operation of the smoothing apparatus in accordance with the present invention.

Next, the block diagram in FIG. 13 will be described.

The devices which are in the area surrounded by a dotted line are those in the image forming apparatus (image formation system), whereas the device outside the area surrounded by the dotted line is a personal computer, which is an external device and is connected to (networked with) the image formation system through a LAN cable.

The controller 400, which is a controlling device, is in connection to the engine portion (image forming means), smoothing apparatus, various flappers (recording means conveyance passage switching means, which will be described later), and fixing device. It has the function of controlling these devices.

Figure 11:
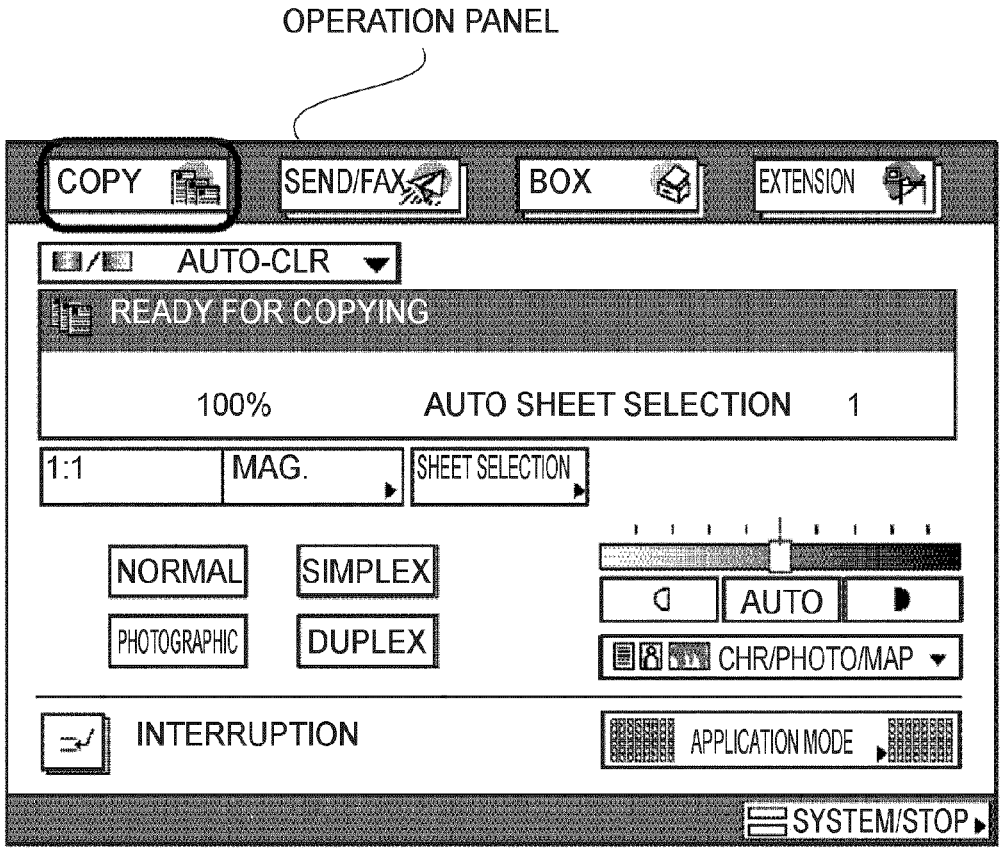
FIG. 11 is a drawing of the graphic control interface displayed in the monitor of the control section of the image forming apparatus.

The controller 400 is also in connection to the graphical control interface, such as the one shown in FIG. 11, displayed on a LCD. That is, the controller 400 controls the above described devices in response to the various settings and operational commands inputted by an operator through the control portion.

More concretely, in this embodiment, the graphical control interface is provided with a "normal (output mode)" key, a "photographic (output mode) key", a "single-sided (image formation mode)" key, and a "two-sided (image formation mode)" key, as shown in FIG. 11. For the purpose of inputting the operational mode in which an operator wishes to operate the image forming apparatus, the operator is to press (touch) the key for the image formation mode which the operator desires. Then, the operator is to press the copy button (unshown). As the button is pressed, the image forming apparatus begins to operate in the desired (selected) mode.

Incidentally, the image formation system is structured so that the variables, such as print count, recording medium size, sorting method, and stapling or not stapling, can also be set through the abovementioned graphical control interface.

Further, the controller 400 is designed so that it is through the network I/F that the controller 400 receives various settings and operational commands (print command, operational mode selection, etc.) inputted by an operator through an external device, and controls the above described devices.

Figure 12:
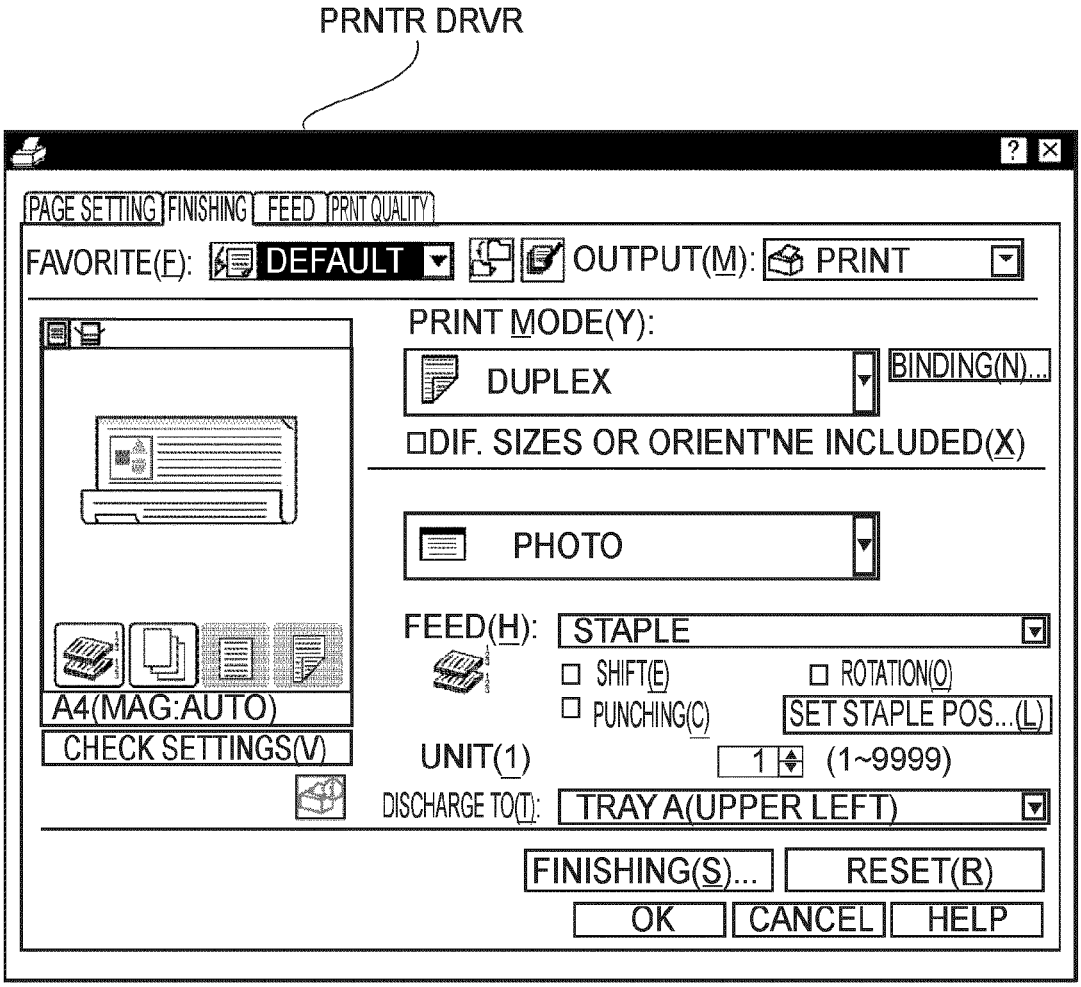
FIG. 12 is a drawing of the graphic control interface of the printer driver of an external device.

More concretely, the graphic printer driver interface is provided with the keys for selecting "two-sided printing (two-sided image formation mode)" or "single-sided printing (single-side image formation mode)", as shown in FIG. 12. The graphic printer driver interface is also provided with the keys for selecting "normal (output mode)" or "photographic (output mode)". An operator is to select the key for the operational mode which the operator wants, and thereafter, click "OK" key (bottom portion in FIG. 12) to affirm the selected various settings and the selected operational mode. After the affirmation, the operator is to click "print start" key (unshown). As "print start" key is clicked, image formation signals are transmitted from the external device to the network I/F, and the image forming apparatus begins to operate in the desired (selected) image formation mode.

Incidentally, the image forming apparatus is designed so that variables, such as the print count, recording medium size, sorting method, to staple or not to stable, etc., can be set from this graphical printer driver interface.

(Operation of Recording Medium Conveyance Mechanism in Single-Sided Image Formation Mode)

Next, the portion of the recording medium conveyance mechanism, which is used in the abovementioned two different single-sided image formation modes will be described.

Figures 9, 9A:
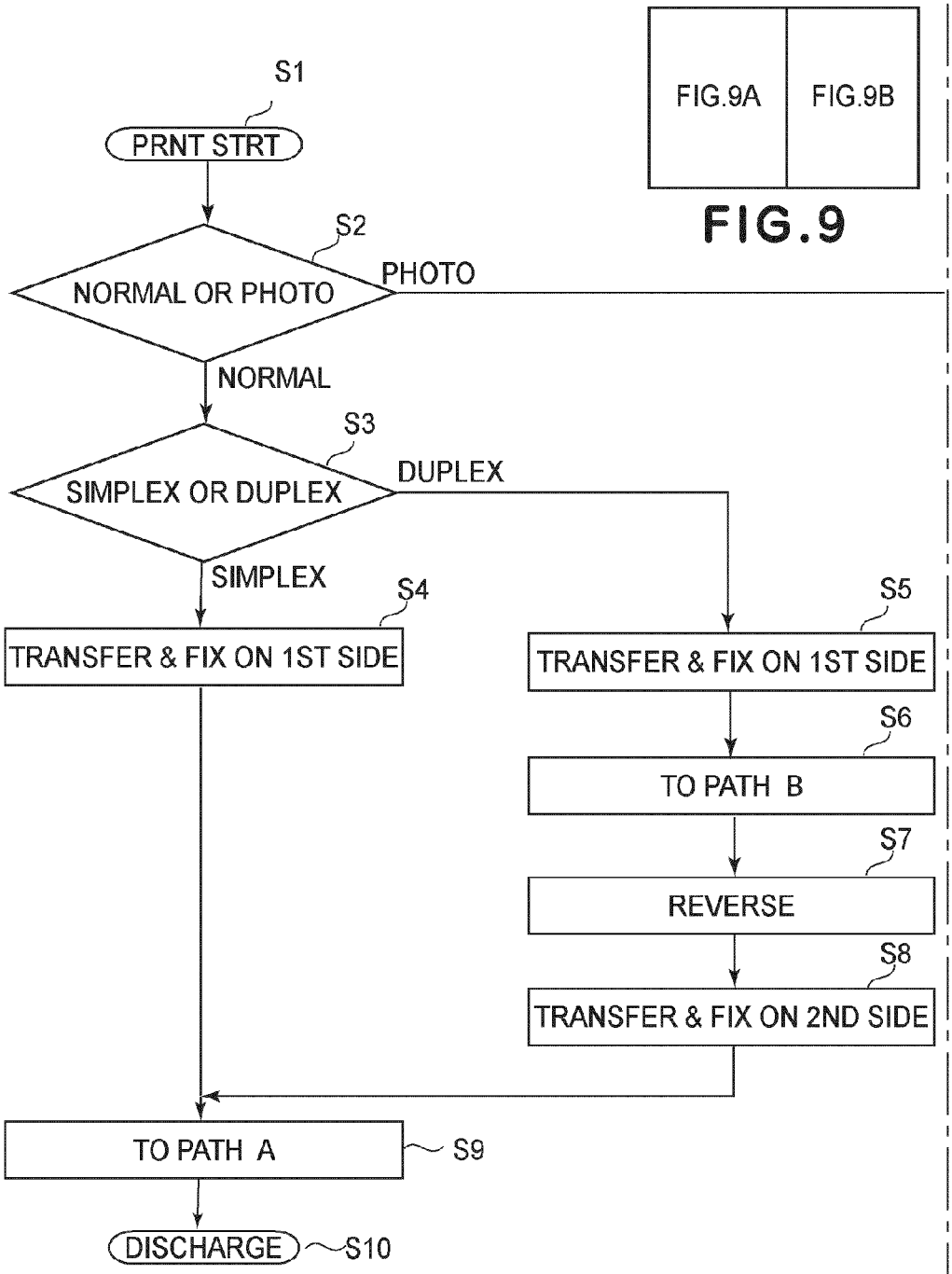
FIG. 9 is a flowchart of the operation of the image forming apparatus in the first embodiment of the present invention.
Figure 9B:
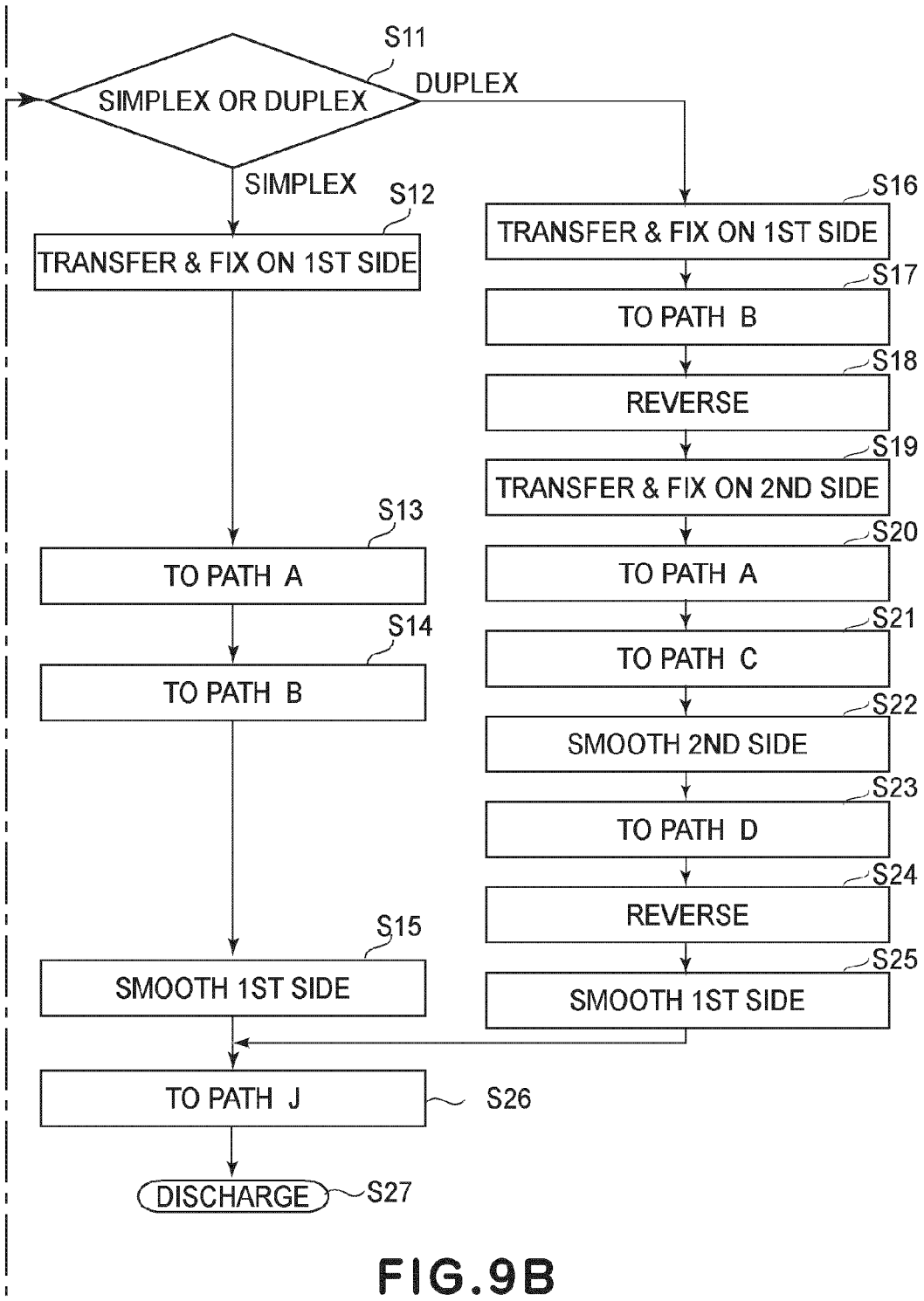

First, the operation of the recording medium conveyance mechanism in the normal single-sided image formation mode (one of two normal output modes), that is, the mode in which ordinary paper or the like is used as recording medium, will be described with reference to the flowchart given in FIG. 9. The flowchart in FIG. 9 is the flowchart for the controller 400 (FIG. 13).

As soon as a print start signal is inputted (S1), the controller 400 determines whether or not the selected image formation mode is the normal mode (S2).

If the selected image formation mode is in the normal output mode, the controller 400 determines whether or not the selected image formation mode is the single-sided image formation mode (S3). If the selected image formation mode is the single-sided image formation mode, the image forming apparatus is operated in the above described normal single-sided image formation mode.

In the normal single-sided image formation mode, the sheets of recording medium in the cassette 100 are conveyed one by one from the cassette 100 to the secondary transfer station by the multiple pairs of conveyance rollers 102, as described above. In the secondary transfer station, the toner images are transferred onto the recording medium. Then, the recording medium is conveyed to the fixing device 10, in which the toner images are fixed to the recording medium (S4).

Thereafter, the recording medium is guided toward the recording medium conveyance passage A by a flapper 31, which is a recording medium conveyance passage switching means. Then, the recording medium is guided into a recording medium conveyance passage E by a flapper 33, which also is a recording medium conveyance passage switching means (S9). Then, the recording medium is discharged out of the apparatus main assembly (S10). The recording medium conveyance passage E is provided with multiple pairs of conveyance rollers 103, as shown in the drawing.

Figure 2:
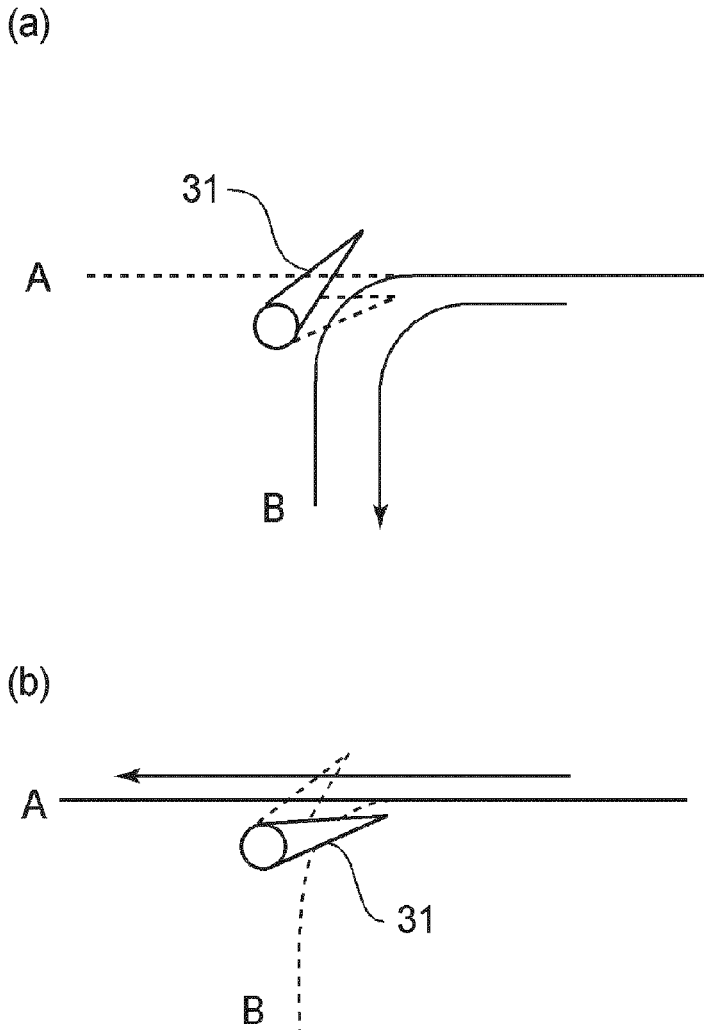
FIG. 2 is a schematic drawing for describing the flapper movement.

At this time, the mechanism for moving the flapper 31 will be described with reference to FIG. 2. Incidentally, the flappers 32 and 33, which will be described later, are the same in structure as the flapper 31, and therefore, will not be described in detail.

The flapper 31 has a rotational axle, and a wing (flap) which is rotatable about the rotational axle. The flapper 31 plays the role of guiding recording medium into the recording medium conveyance passage A which extends leftward from the right-hand side of the drawing, or the recording medium conveyance passage B which extends downward in the drawing. That is, when the flapper 31 is in the position shown in FIG. 2(*a*), it guides recording medium downward into the recording medium conveyance passage B, whereas when it is in the position shown in FIG. 2(*b*), it guides recording medium leftward into the recording medium conveyance passage A.

Incidentally, the rotational axle of the flapper 31 is in connection to a motor. Thus, the orientation (position) of the flap of the flapper 31 is controlled by the controller which controls the rotational direction, etc., of the motor.

The smoothing apparatus may be provided an additional recording medium conveyance passage, in addition to the above described recording medium conveyance passages A and B. If the smoothing apparatus is provided with the additional recording medium conveyance passage, the flapper 31 is enabled to guide recording medium in three different directions.

Next, referring to FIG. 9, the special single-sided image formation mode (one of photographic output mode), that is, the mode provided for the usage of single-sided resinous medium, will be described.

If the controller 400 determines in S2 that the selected image formation mode is the photographic mode, it determines whether or not the selected mode is the single-sided image formation mode (S11).

If the controller 400 determines that the selected mode is the single-sided image formation mode, the above described special single-sided image formation mode is carried out.

In the special single-sided image formation mode, single-sided resinous medium is conveyed by the multiple pairs of conveyance rollers 102 to the secondary transfer station from the cassette 100 which is holding multiple sheets of single-sided resinous medium. After the transfer of toner images onto the single-sided resinous medium in the secondary transfer station, the single-sided resinous medium is conveyed to the fixing device 10, in which the toner images are temporarily fixed to the single-sided resinous medium (S12). At the end of this temporary fixation, the surface of the single-sided resinous medium, on which the toner images are present, appears as shown in FIG. 4(*a*).

Thereafter, the single-sided resinous medium is guided by the flapper 31 toward the recording medium conveyance passage A (S13). The recording medium conveyance passage A is provided with a pair of conveyance roller 27 which convey the recording medium to the smoothing apparatus 20, as shown in the drawing.

Then, the single-sided resinous medium is guided into the recording medium conveyance passage C by the flapper 33, reaching thereby the smoothing apparatus 20 (S14). The recording medium conveyance passage C is provided with a pair of conveyance rollers 106 for discharging recording medium out of the apparatus. In the smoothing apparatus 20, the surface of the single-sided resinous medium, on which the toner images are present, is smoothed by embedding the toner images into the toner reception layer (FIG. 4(*b*)). After the smoothing of the single-sided resinous medium across the surface having the toner images, the single-sided resinous medium is guided into the recording medium conveyance passage J by the flapper 32, which also is a recording medium conveyance direction switching means (S26), and then, is discharged out of the apparatus (S27).

(Two-Side Image Formation Mode)

The image forming apparatus in this embodiment is capable of operating in two different two-sided image formation modes in which toner images are formed on both of the two surfaces of recording medium, as will be described later. The image forming apparatus is designed so that it can be made to operate in either of the two different two-sided image formation modes, by a command which is to be inputted by an operator through the control portion of the image forming apparatus as in the single-side image formation mode. Incidentally, when the image forming apparatus is used simply as a printer, commands, such as the one described above, are to be inputted through an external device networked with the image forming apparatus.

One of the two two-sided image formation modes is a normal (first) two-sided image formation mode (one of normal output modes). In this mode, toner images are formed on one of the two surfaces of a sheet of recording medium, such as ordinary paper, and is fixed by the fixing device 10. Then, toner images are formed on the other surface of the recording medium, and then, the recording medium is discharged out of the apparatus.

The second of the two different two-sided image formation modes is a special two-sided image formation mode (one of photographic output modes). In this mode, first, toner images are formed on one of the two surfaces of a sheet of two-sided resinous medium, and are fixed. Then, the recording medium is smoothed across the surface having the toner images. Next, toner images are formed on the other surface of the two-sided resinous medium, and are fixed. Then, the two-sided resinous medium is smoothed across the second surface. Then, the two-sided resinous medium is discharged out of the apparatus.

More concretely, first, toner images are formed on one (first) of the two surfaces of a sheet of two-sided resinous medium, and are fixed by the fixing device 10. Then, toner images are formed on the other (second) surface of the two-sided resinous medium, and are fixed. Then, the two-sided resinous medium is introduced into the smoothing apparatus 20, in which the two surfaces of the two-sided resinous medium are sequentially smoothed. Then, the two-sided resinous medium is discharged out of the apparatus. Incidentally, fixing means such a process that is for fixing toner images to the toner reception layer just enough to prevent the toner from offsetting to the conveyance rollers and the like while the two-sided resinous recording medium is conveyed. That is, the fixing process in this two-sided image formation mode may be referred to as "temporarily fixing process". It is different from the fixation process in the normal two-sided fixation mode in terms of the condition and result of fixation.

(Operation of Recording Medium Conveyance Mechanism in Two-Sided Image Formation Mode)

Next, the operation of the recording medium conveyance mechanism in each of the two different two-sided image formation modes will be described.

First, the operation of the recording medium conveyance mechanism in the normal two-sided image formation mode (one of two normal output modes), that is, the mode in which ordinary paper or the like is used as recording medium, will be described.

As soon as a print start signal is inputted (S1), the controller 400 determines whether or not the selected image formation mode is the normal output mode (S2).

If the selected image formation mode is the normal output mode, the controller 400 determines whether or not the selected image formation mode is the single-sided image formation mode (S3). If the selected image formation mode is the two-sided image formation mode instead of the single-sided image formation mode, the image forming apparatus is operated in the above described normal two-sided image formation mode. In the normal two-sided image formation mode, the sheets of recording medium in the cassette 100 are conveyed one by one from the cassette 100 to the secondary transfer station by the multiple pairs of conveyance rollers 102, as described above. In the secondary transfer station, the toner images are transferred onto the recording medium. Then, the recording medium is conveyed to the fixing device 10, in which the toner images are fixed to the recording medium (S5).

Thereafter, the recording medium is guided by a flapper 31 toward the recording medium conveyance passage B (S6), in which the recording medium is turned over (S7). Then, the recording medium is again guided into the second transfer station. The recording medium conveyance passage B is provided with multiple pairs of conveyance rollers 104, inclusive of the rollers (reversal rollers) for turning over the recording medium, as shown in the drawing.

After the transfer of toner images onto the second surface of the two-sided resinous medium in the secondary transfer station, the recording medium is conveyed to the fixing device 10, in which the toner images are fixed to the second surface of the recording medium (S8). Thereafter, the recording medium is guided toward the recording medium conveyance passage A by the flapper 31. Then, the recording medium is guided into the recording medium conveyance passage E (S9), and is discharged out of the apparatus (S10).

Next, the special two-sided image formation mode (one of photographic output modes), that is, the mode provided for the usage of two-sided resinous medium, will be described.

As soon as a print start signal is inputted (S1), the controller 400 determines whether or not the selected image formation mode is the normal output mode (S2).

If the selected image formation mode is the photographic mode instead of the normal output mode, the controller 400 determines whether or not the selected image formation mode is the single-sided image formation mode (S11). If the selected image formation mode is the two-sided image formation mode instead of the single-sided image formation mode, the image forming apparatus is operated in the above-mentioned special two-sided image formation mode.

In the special two-sided image formation mode, the sheets of recording medium in the cassette 100 are conveyed one by one from the cassette 100 to the secondary transfer station by the multiple pairs of conveyance rollers 102, as described above. In the secondary transfer station, the toner images are transferred onto one (first) of the recording medium. Then, the recording medium is conveyed to the fixing device 10, in which the toner image(s) is temporarily fixed to the first surface of the recording medium (S16).

Thereafter, the recording medium is guided by a flapper 31 toward the recording medium conveyance passage B (S17), in which the recording medium is turned over (S18). Then, the recording medium is again guided into the second transfer station.

After the transfer of toner images onto the second surface of the two-sided resinous medium in the secondary transfer station, the recording medium is conveyed to the fixing device 10, in which the toner images are temporarily fixed to the second surface of the recording medium (S19).

Thereafter, the recording medium is immediately conveyed to the recording medium conveyance passage A by the flapper 31, without being guided into the recording medium conveyance passage B for turning over the recording medium (S20). Then, the recording medium is guided into the recording medium conveyance passage C by the flapper 33 (S21), being thereby conveyed to the smoothing apparatus 20, in which the two-sided resinous medium is smoothed across its second surface (S22).

After the smoothing of the second surface of the two-sided resinous medium, the two-sided resinous medium is guided into the recording medium conveyance passage D by the flapper 32 (S23), in which the two-sided resinous medium is turned over (S24). Then, the two-sided resinous medium is conveyed again to the smoothing apparatus 20 (pair of conveyance rollers 27). The recording medium conveyance passage D is provided with multiple pairs of conveyance rollers 105, inclusive of the rollers (reversal rollers) for turning over the recording medium, as shown in the drawing.

Then, the first surface of the two-sided resinous medium is smoothed in the smoothing apparatus 20 (S25)

After the two-sided resinous medium is smoothed across both of its surfaces, it is guided toward the recording medium conveyance passage J by the flapper 32 (S26), and then, is discharged out of the apparatus (S27).

To summarize, in the special two-sided image formation mode, two-sided resinous medium is subjected to the step of fixing toner images to one (first) of the two surfaces of two-sided resinous medium—step of fixing toner images to the other (second) surface of two-sided resinous medium—step of smoothing the second surface of the two-sided resinous medium—step of smoothing the first surface of the two-sided resinous medium, in the listed sequence, and then, is discharged out of the apparatus.

Comparative Embodiment

Figure 6:
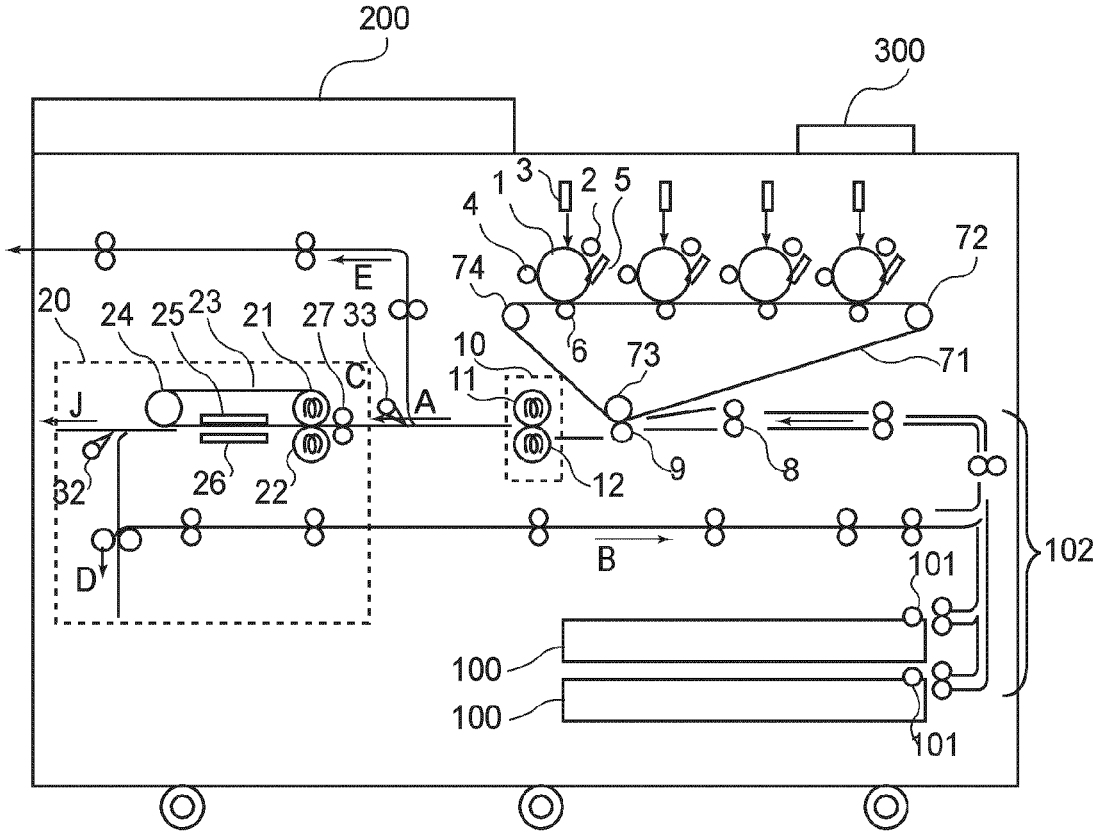
FIG. 6 is a schematic sectional view of the image forming apparatus in the comparative embodiment.
Figure 7:
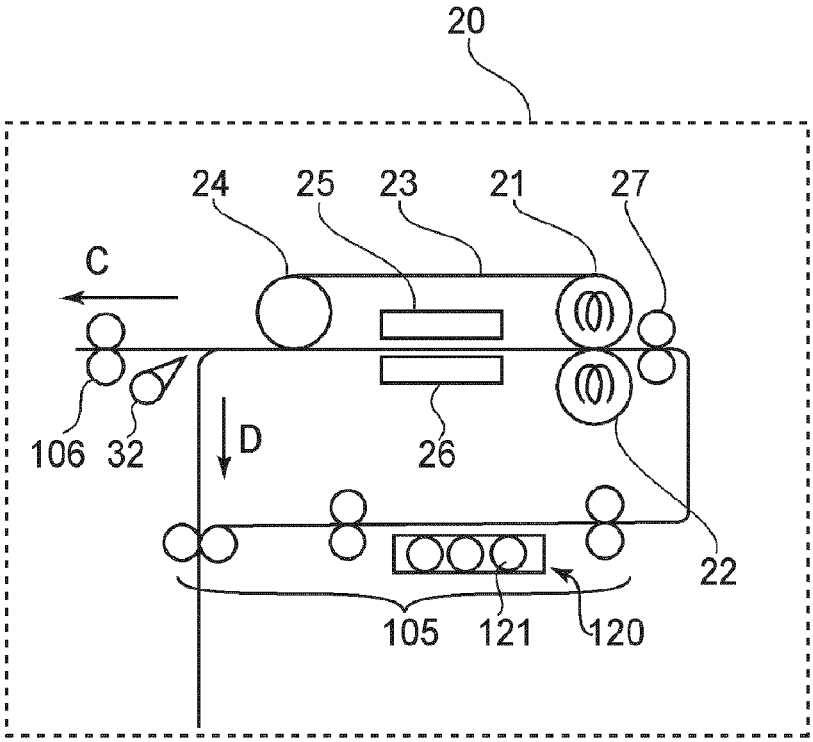
FIG. 7 is a schematic sectional view of the smoothing apparatus which pre-heats recording medium.

Next, a case in which the two-sided image formation mode is carried out by the image forming apparatus, in a comparative embodiment, structured as shown in FIG. 6, using two-sided resinous medium as recording medium, will be described.

The image forming apparatus shown in FIG. 6 is different in structure from the image forming apparatus in the first embodiment (FIG. 1) in that the portion of its recording medium conveyance passage, which is for forming toner images both surfaces of recording medium, is different from that of the image forming apparatus in the first embodiment. Otherwise, it is the same in structure as the image forming apparatus in the first embodiment, and therefore, will not be described in detail.

That is, roughly speaking, in this comparative embodiment, as the two-sided image formation mode for the usage of two-sided resinous medium is selected, the two-sided resinous medium is subjected to the step of fixing toner images to the first surface—step of smoothing the first surface—step of fixing toner images to the second surface step of smoothing the second surface, in the listed order.

Also roughly speaking, in this operation, the recording medium is conveyed through the fixing device—conveyance passage A—conveyance passage C—smoothing apparatus—conveyance passage D—conveyance passage B—fixing device—conveyance passage A—conveyance passage C—smoothing apparatus—conveyance passage J, in the listed order.

Thus, while the two-sided resinous medium is conveyed to the smoothing apparatus 20, for the smoothing of its second surface, through the long recording conveyance passages, the smoothed first surface of the two-sided resinous medium was made unsmooth by the conveyance rollers, conveyance guides, etc.

Further, unlike in the case of the first embodiment, the smoothed first surface of the two-sided resinous medium was put through the heat and pressure by the fixing apparatus 10. This was thought to have also contributed to the roughening of the smoothed first surface of the two-sided resinous medium. This problem occurred because, in this comparative embodiment, the fixing device 10 was such a fixing device that separates recording medium from the fixation belt immediately after heating the toner images, in other words, without aggressively cooling the recording medium; the recording medium was separated from the belt while the temperature of the recording medium was still high.

Given below in Table 1 are the results of the evaluation of the two surfaces of the prints outputted by the image forming apparatus in the first embodiment, and the two surfaces of the prints outputted by the image forming apparatus in the comparative embodiment, in terms of glossiness. In Table 1, the first surface of a sheet of two-sided resinous medium, onto which toner images were transferred is referred to as the "first surface", and the second surface of the sheet of two-sided resinous medium, onto which toner images were transferred is referred to as "second surface".

TABLE 1

| Glossiness (60 deg.) | 1st side (first transfer) | 2nd side (second transfer) |
|---|---|---|
| Embodiment | 100 | 80 |
| Comp. Example | 60 | 100 |

The evaluation given in Table 1 is the evaluation of the two-sided prints produced under the following conditions. That is, a high density solid image was formed on a sheet of two-sided resinous medium by transferring in layers two toner images, different in color, onto the sheet of two-sided resinous medium. Then, the glossiness level of the print was measured across the actual image portion of the print. The method used for measuring the glossiness level of the print was the specular gloss level measuring method JIS Z 8741. The glossmeter used for the measurement was a handy glossimeter PG-1M (product of Nippon Denshoku Co., Ltd.). The glossiness level was measured at 60°.

In the case of the comparative embodiment, the glossiness level of the second surface was 100, which is very high. However, the glossiness of the first surface was 60, to which it had reduced for the reason given above. In other words, the image forming apparatus in the comparative embodiment failed to form a highly glossy image on both surfaces of a sheet of two-sided resinous medium.

On the other hand, in the case of the first embodiment, the glossiness of the first surface, that is, the second surface in terms of smoothing, was 100, which is very high. Further, the glossiness of the second surface, that is, the first surface in terms of smoothing, was 80, which is slightly lower than that of the first surface, but, is still satisfactory. That is, in the case of the first embodiment, it was possible to form an image, which was satisfactorily high in glossiness, on both surfaces of a sheet of two-sided resinous medium.

Embodiment 2

Next, the second embodiment of the present invention will be described with reference to the image forming apparatus shown in FIG. 2. This embodiment is different in the structure of the image forming apparatus from the first embodiment in that the image forming apparatus in this embodiment employs a transfer belt which bears and conveys recording medium. Otherwise, the image forming apparatus in this embodiment is the same as that in the first embodiment, and therefore, will not be described in detail.

In this embodiment, the image formation stations Y, M, C, and K are vertically juxtaposed in parallel. The structural components of each image formation station are the same as those in the first embodiment.

The image forming apparatus in this embodiment is provided with a circularly movable transfer belt 76, as a recording medium holding member, which is in contact with the photosensitive drum of each image formation station.

The transfer belt 76 is stretched around a driver roller 77, a tension roller 79, and a follower roller 78. It is circularly moved in the clockwise direction in FIG. 4 by the force it receives from the driver roller 77.

A sheet of recording medium is conveyed from the cassette 100, which is holding multiple sheets of recording medium, to a pair of registration rollers 8, which send the recording medium to the transfer belt 76 with such a timing that a toner image formed on the photosensitive drum enters the transfer station at the same time as the recording medium enters the transfer station.

As the recording medium arrives at the transfer belt 76 after being sent thereto by the registration rollers 8, it is electrostatically adhered to the transfer belt 76. Then, it is sequentially conveyed through the transfer stations of the four image formation stations.

In the transfer stations, transfer bias is applied to transfer rollers 75Y-75K, whereby the four toner images different in color are sequentially transferred in layers onto the recording medium on the transfer belt 75. As a result, a single full-color image is effected on the recording medium. Thereafter, the recording medium is introduced into the fixing apparatus 10, and then, is discharged out of the apparatus. When forming an image on resinous recording medium, the recording medium is conveyed from the fixing device 10 to the smoothing apparatus 20, and then, is discharged out of the apparatus.

Figures 10, 10A:
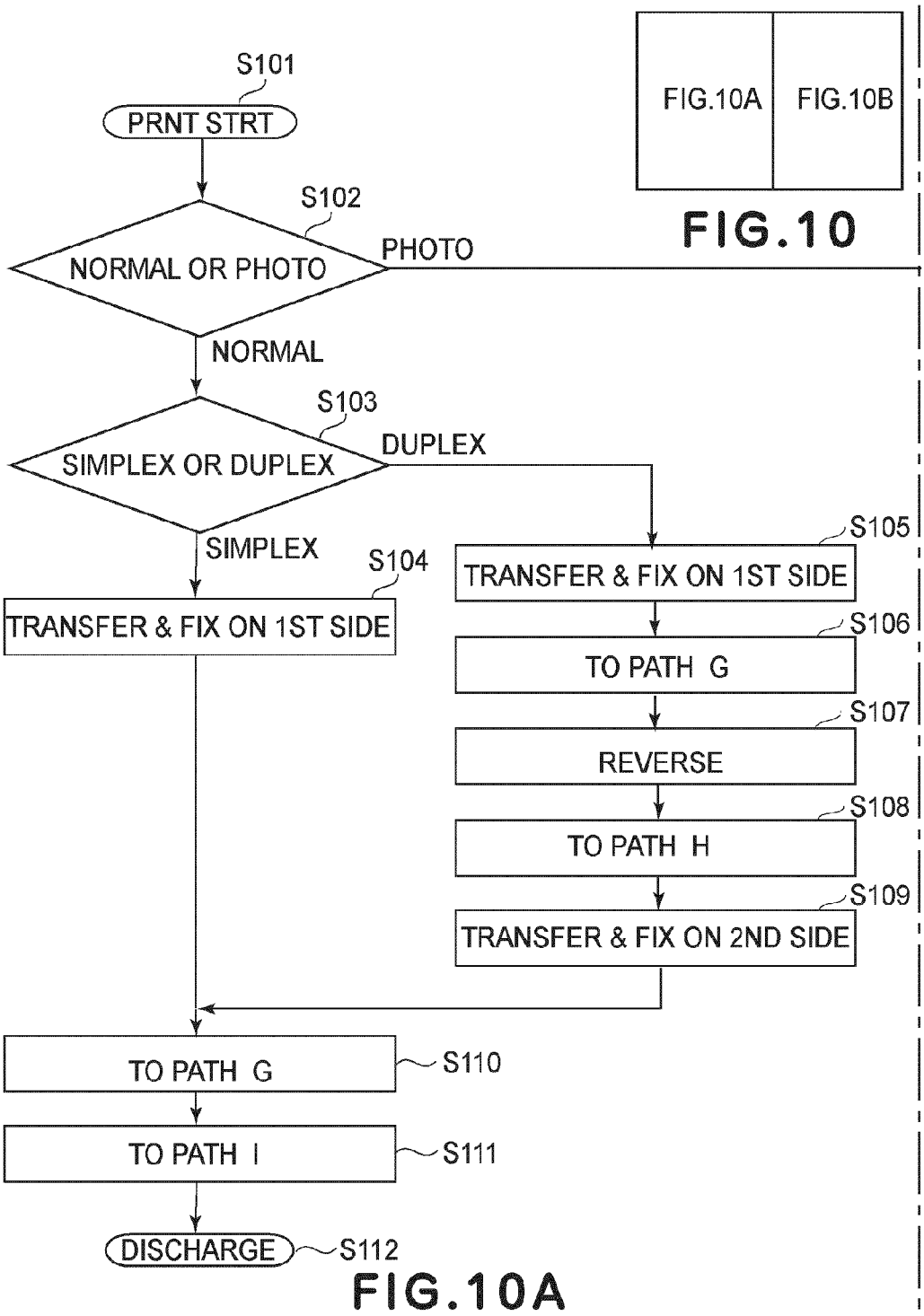
FIG. 10 is a flowchart of the operation of the image forming apparatus in the second embodiment of the present invention.
Figure 10B:
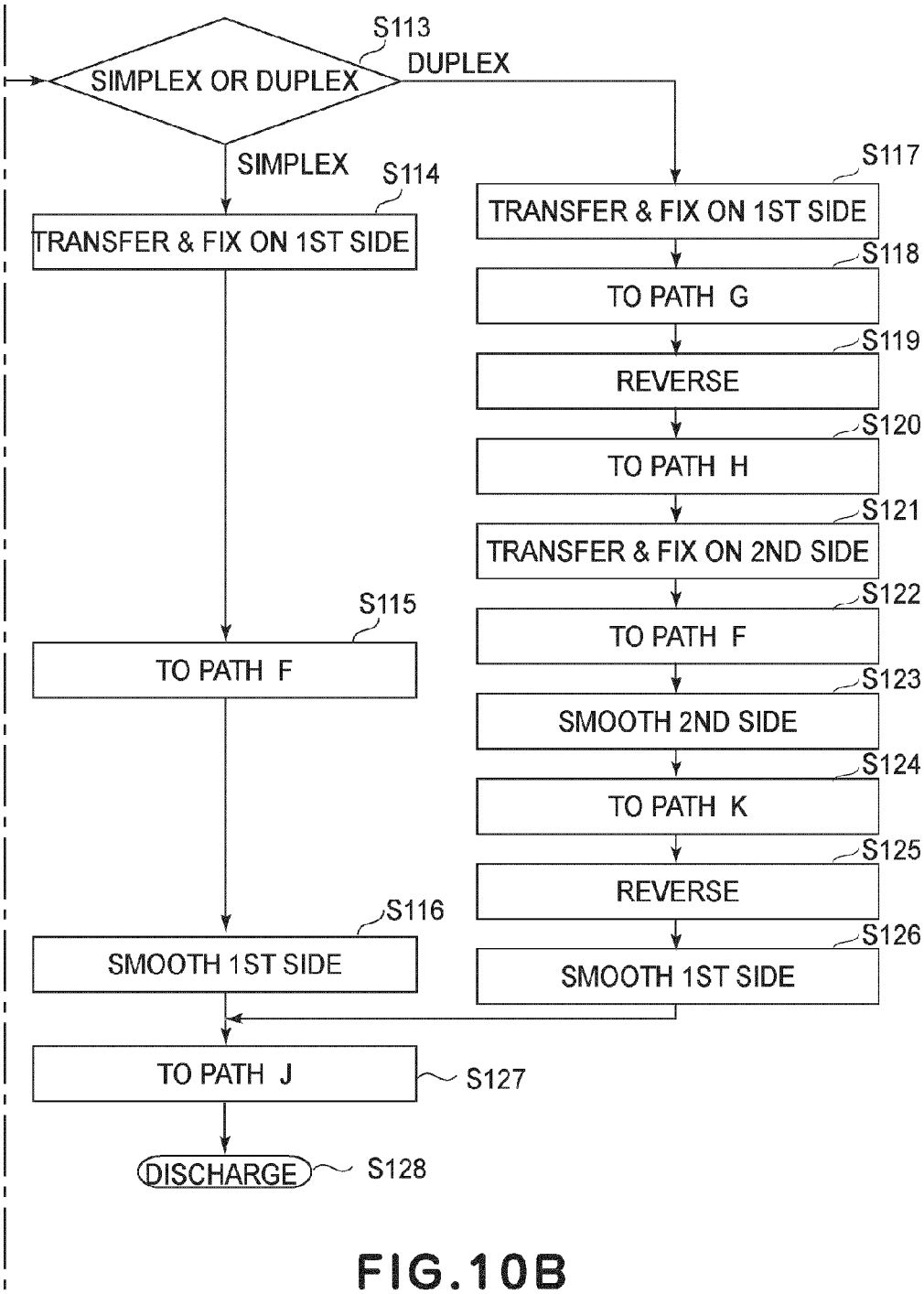

Next, the single-sided image formation mode in this embodiment will be described with reference to the flowchart shown in FIG. 10, which is for the controller 400.

(Single-Sided Image Formation Mode)

Also in this embodiment, the image forming apparatus is capable of operating in two different single-sided image formation modes, that is, the normal (first) single-sided image formation modes, that is, the single-sided image formation mode for the usage of ordinary paper or the like, and the special (second) single-sided image formation mode, that is, the mode for the usage of single-sided resinous recording medium.

First, the normal single-sided image formation mode will be described.

As soon as a print start signal is inputted (S101), the controller 400 determines whether or not the selected image formation mode is the normal mode (S102).

If the image forming apparatus is in the normal output mode, the controller 400 determines whether or not the selected image formation mode is the single-sided image formation mode (S113). If the selected image formation mode is the single-sided image formation mode, the image forming apparatus is operated in the above described normal single-sided image formation mode. In the normal single-sided image formation mode, the sheets of recording medium in the cassette 100 are conveyed one by one by the pickup roller 101 from the cassette 100 to the pair of registration rollers 8, and then, are conveyed by the registration rollers 8 to the transfer belt 76.

After being delivered onto the transfer belt 76, the recording medium receives a toner image from each image formation station as it is moved through the transfer station of the image formation station. Thereafter, it is separated from the transfer belt by the curvature of the transfer belt 76. Then the recording medium, onto which toner images have just been transferred, is conveyed to the fixing device 10, in which the toner images are fixed to the recording medium (S104).

Thereafter, the recording medium is guided by the flapper 34 toward a recording medium conveyance passage G as a recording medium conveyance passage switching means (S110). Then, the recording medium is conveyed by a flapper 35, which is also a recording medium conveyance passage switching means, toward a recording medium conveyance passage I (S111), and then, is discharged out of the apparatus (112). The recording medium conveyance passages G and I are provided with a pair of conveyance rollers, as shown in the drawing.

Next, referring to FIG. 10, the special single-sided image formation mode will be described.

As a print start signal is inputted (S101), the controller 400 first determines whether or not the selected image formation mode is the normal output mode (S102).

If the selected image formation mode is the photographic output mode instead of the normal output mode, the controller 400 determines whether or not the selected image formation mode is the single-sided image formation mode (S113). If the selected image formation mode is the singe-sided image formation, the above described special single-sided image formation mode is carried out.

In the special single-sided image formation mode, the sheets of single-sided resinous medium in the cassette 100 are conveyed one by one by the pickup roller 101 from the cassette 100 to the registration rollers 8, and then, are conveyed by the registration rollers 8 to the transfer belt 76.

After being delivered onto the transfer belt 76, the single-sided resinous medium receives a toner image from each image formation station as it is moved through the transfer station of the image formation station. Thereafter, it is separated from the transfer belt by the curvature of the transfer belt 76. Then the single-sided resinous medium, onto which toner images have just been transferred, is conveyed to the fixing device 10, in which the toner images are temporarily fixed to the recording medium (S114).

Thereafter, the single-sided resinous medium is guided by the flapper 34 toward the recording medium conveyance passage F, reaching thereby the smoothing apparatus 20 (S115). The recording medium conveyance passage F is provided with a pair of conveyance rollers 27.

In the smoothing apparatus 20, the surface of the single-sided resinous medium, on which the toner images are present, is smoothed (S116). Thereafter, the single-sided resinous medium is guided by a flapper 36, which is a recording medium conveyance direction switching means, toward the recording medium conveyance passage J (S127), and then, is discharged out of the apparatus (S128). The recording medium conveyance passage J is provided with a pair of conveyance rollers as shown in the drawing.

Next, the two-sided image formation mode will be described.

(Two-Sided Image Formation Mode)

Also in this embodiment, the image forming apparatus is capable of operating in two different modes, that is, the normal (first) two-sided image formation mode, that is, the mode for the usage of ordinary paper or the like, and the special (second) two-sided image formation mode, that is, the mode for the usage of two-sided resinous recording medium.

First, the normal two-sided image formation mode will be described.

As soon as a print start signal is inputted (S101), the controller 400 first determines whether or not the selected image formation mode is the normal output mode (S102).

If the selected image formation mode is the normal output mode, the controller 400 determines whether or not the selected image formation mode is the single-sided image formation mode (S103). If it is the two-sided image formation mode instead of the single-sided image formation mode, the image forming apparatus is operated in the above described normal two-sided image formation mode.

In the normal two-sided image formation mode, the sheets of recording medium in the cassette 100 are conveyed one by one by the pickup roller 101 from the cassette 100 to the registration rollers 8, and then, are conveyed by the registration rollers 8 to the transfer belt 76.

After being delivered onto the transfer belt 76, the recording medium receives a toner image from each image formation station as it is moved through the transfer station of the image formation station. Thereafter, it is separated from the transfer belt 76 by the curvature of the transfer belt 76. Then the recording medium, onto which toner images have just been transferred, is conveyed to the fixing device 10, in which the toner images are fixed to the first surface of the recording medium (S105).

Thereafter, the recording medium is guided by the flapper 34 toward the recording medium conveyance passage G (S106), and then, is guided by the flapper 35, which is a recording medium conveyance direction switching means, toward the recording medium conveyance passage H(S107). At the entrance of the recording medium conveyance passage H (at the branching point between recording medium conveyance passages G and H), the recording medium is turned over (S108). The recording medium conveyance passage H is provided with multiple pairs of conveyance rollers, inclusive of reversal rollers for switch-backing the recording medium to turn over the recording medium, as shown in the drawing.

Then, the recording medium is again conveyed to the transfer belt 76 by the recording medium conveyance passage H. Then, toner images are transferred onto the second surface of the recording medium, and then, the recording medium is conveyed to the fixing device 10.

After the transfer of the toner images onto the second surface of the recording medium, the recording medium is subjected to the fixing process by the fixing apparatus 10 (S109), and is guided by the flapper 34 toward the recording medium conveyance passage G (S110). Next, it is guided by the flapper 35 toward the recording medium conveyance passage I (S111), and then, is discharged out of the apparatus (S112).

Next, the special two-sided image formation mode will be described.

As soon as a print start signal is inputted (S101), the controller 400 determines whether or not the selected image formation mode is the normal output mode (S102).

If it is the photographic mode instead of the normal output mode, the controller 400 determines whether or not the selected image formation mode is the single-sided image formation mode (S113). If it is the two-sided image formation mode instead of the single-sided image formation mode, the image forming apparatus is operated in the above described special two-sided image formation mode.

In the special two-sided image formation mode, the sheets of recording medium in the cassette 100 are conveyed one by one by the pickup roller 101 from the cassette 100 to the registration rollers 8, and then, is conveyed by the registration rollers 8 to the transfer belt 76.

After being delivered onto the transfer belt 76, one (first) of the two surfaces of the two-sided resinous medium receives one image per transfer station as it is sequentially conveyed through the multiple transfer stations. Thereafter, the recording medium is separated from the transfer belt 76 by the curvature of the belt 76. Then, the two-sided resinous medium having toner images on one (first) of its two surfaces is conveyed to the fixing apparatus 10, in which the first surface of the two-sided resinous medium is subjected to the fixation process (S117).

Thereafter, the two-sided resinous medium is guided by a flapper 34 toward the recording medium conveyance passage G (S118), and then, is guided by the flapper 35 toward the recording medium conveyance passage H (S120). At the entrance of the recording medium conveyance passage H (branching point between recording medium conveyance passages G and H), the recording medium is turned over (S119).

Then, the recording medium is conveyed again to the transfer belt 76 by the recording medium conveyance passage H. Then, toner images are transferred onto the other (second) surface of the two-sided resinous medium. Then, the recording medium is conveyed to the fixing apparatus 10, in which the second surface of the two-sided resinous medium, that is, the surface onto which the toner images have just been transferred, is subjected to the process in which the toner images are temporarily fixed (S121).

Thereafter, the two-sided resinous medium is immediately conveyed to the recording medium conveyance passage F by the flapper 34, without being guided into the recording medium conveyance passage H for turning over the recording medium, being conveyed thereby to the smoothing apparatus 20 (S122), in which the two-sided resinous medium is smoothed across its second surface (S123).

After the smoothing of the second surface of the two-sided resinous medium, the two-sided resinous medium is guided by the flapper 36 toward a recording medium conveyance passage K (recording medium reversing passage) (S124). In the recording medium conveyance passage K, the two-sided resinous medium is turned over (S125). Then, the two-sided resinous medium is conveyed again to the smoothing apparatus 20 (pair of conveyance rollers 27). The recording medium conveyance passage K is provided with multiple pairs of conveyance rollers, inclusive of the rollers (recording medium reversing rollers) for turning over the recording medium, as shown in the drawing.

Then, the first surface of the two-sided resinous medium is smoothed in the smoothing apparatus 20 (S126). After the two-sided resinous medium is smoothed across the first surface (second surface has been already smoothed), it is guided toward the recording medium conveyance passage J by the flapper 36 (S127), and then, is discharged out of the apparatus (S128).

To summarize, in the special two-sided image formation mode, two-sided resinous medium is subjected to the step of fixing the toner images on one (first) of the two surfaces of two-sided resinous medium—step of fixing toner images on the other (second) surface of two-sided resinous medium—step of smoothing the second surface of the two-sided resinous medium—step of smoothing the first surface of the two-sided resinous medium, in the listed sequence, and then, is discharged out of the apparatus.

Incidentally, the abovementioned flappers 34-36 are similar in structure to the above described flappers 31 (-33) in the first embodiment, and therefore, will not be described in detail.

As described above, the same effects as those obtained by the image forming apparatus in the first embodiment can also be obtained by the image forming apparatus in this embodiment, that is, an image forming apparatus employing a transfer belt. That is, the image forming apparatus in this embodiment can also form a highly glossy image on both surfaces of a sheet of two-sided resinous recording medium.

Embodiment 3

This embodiment is different from the first embodiment in that the image forming apparatus in this embodiment is provided with a heating apparatus for heating two-sided resinous recording medium before it enters the smoothing apparatus. Otherwise, the image forming apparatus in this embodiment is the same in structure as that in the first embodiment, and therefore, will not be described in detail.

The inventors of the present invention paid attention to the fact that in the special two-sided image formation mode, the temperature of the two-sided resinous medium immediately before the first surface of the two-sided resinous medium is smoothed is lower than that immediately before the second surface of the two-sided resinous medium is smoothed.

Incidentally, the definition of the "first surface" of resinous medium in this embodiment is the same as the in the first embodiment. That is, "first surface" means the first surface in terms of the order in which toner images were transferred; it does not means the first surface in terms of the order of smoothing.

More concretely, the temperature of two-sided resinous medium immediately before the medium was introduced into the smoothing apparatus to smooth its second surface was roughly 100 degrees, which was the temperature level to which the temperature of the medium was raised by the fixing apparatus 10. On the other hand, the temperature of two-sided resinous medium immediately before the medium was introduced into the smoothing apparatus to smooth its first surface was roughly 50 degrees, because the medium was cooled by the cooling apparatuses 25 and 26 after the completion of the step of smoothing the second surface of the medium.

That is, the difference between the temperature of two-sided resinous medium immediately before the smoothing of its first surface and that before the smoothing of its second surface was roughly 50 degrees.

Then, when the first surface of two-sided resinous medium was smoothed under roughly the same conditions (heating temperature, pressure, medium conveyance speed) as those under which the second surface of two-sided resinous medium was smoothed, the toner was not embedded into the toner reception layer as satisfactorily as it was when the second surface was smoothed. Consequently, the glossiness level of the smoothed first surface of the two-sided resinous medium was roughly 20 degrees lower than that of the smoothed second surface.

In this embodiment, therefore, in order to prevent the problem that when two-sided resinous medium is used as recording medium, a print, the two surfaces of which are different in glossiness, is yielded, a heating apparatus 120 is positioned next to the recording medium conveyance passage D to preheat the two-sided resinous medium immediately before the first surface of the two-sided resinous medium is smoothed.

The heating apparatus 120 is positioned so that while two-sided resinous medium is conveyed through the recording medium conveyance passage D, the first surface of two-sided resinous medium is on the heating apparatus side. The heating apparatus 120 is designed to heat the first surface side of two-sided resinous medium without contacting the surface. More specifically, the heating apparatus 120 is positioned roughly 10 mm away from the recording medium conveyance passage D.

The heating apparatus 120 has multiple metallic rollers 121 as heating members, which are juxtaposed in parallel in the direction parallel to the direction in which recording medium is advanced through the recording medium conveyance passage D. Each metallic roller 121 is provided with a halogen heater as a heat source, which is located in the hollow of the metallic roller.

In consideration of the thermal conductivity of the heating members, each metallic roller 121 is formed of metal such as aluminum, and is heated by the halogen heater so that the temperature of its peripheral surface becomes and remains at roughly 100 degrees. In the immediate adjacencies of the peripheral surface of each metallic roller 121 a thermistor is located as a means for detecting the temperature of the metallic roller 121. The amount of the power supply to the halogen heater is controlled by the controller in response to the output of the thermistor.

The selection of the preheating means does not need to be limited to the heating apparatus 120 described above. That is, the smoothing apparatus may be structured so that the resinous medium is heated by a halogen heater, without presence of the metallic rollers and with no contact between the resinous medium and halogen heater. In this embodiment, in consideration of the safety in terms of recording medium conveyance, the halogen heater is positioned in the hollow of each metallic rollers. It is not mandatory that the member in which a halogen heater is placed is in the form of a roller and is formed of metal. That is, the member in which a halogen heater is placed may be in a form different from that of a roller.

Next, the two-sided image formation mode for two-sided resinous medium, which is carried out by a smoothing apparatus having the heating apparatus 120 described above will be described. The two-sided image formation mode for two-sided resinous medium, which will be described with reference to a case in which the mode is carried out by the heating apparatus in this embodiment, which is combined with the image forming apparatus shown in FIG. 1.

The portion of the operational sequence up to the end of the fixation step, that is, transfer of toner images onto one (first) of the two surfaces of a sheet of two-sided resinous medium—fixation of the toner images on the first surface—transfer of toner images onto the other (second) surface—fixation of the toner images on the second surface, is the same as those in the first and second embodiments.

In this embodiment, thereafter, the two-sided resinous medium is conveyed toward the smoothing apparatus 20 without being turned over. During this conveyance, the two-sided resinous medium is not heated by the heating apparatus 120. After being introduced into the smoothing apparatus 20, the two-sided resinous medium is smoothed across the second surface.

Then, the two-sided resinous medium, the second surface of which has just been smoothed, is guided by the flapper 32 toward the recording medium conveyance passage D, in which it is turned over.

While the two-sided resinous medium is conveyed through the recording medium conveyance passage D, it is preheated by the heating apparatus 120, and then, is conveyed again to the smoothing apparatus 20.

Then, after the smoothing of the first surface by the smoothing apparatus 20, the two-sided resinous medium, that is, the two-sided resinous medium which has been smoothed across both of its surfaces, is guided by the flapper 32 toward the recording medium conveyance passage C, and then, is discharged from the apparatus.

To summarize, in the special two-sided image formation mode, two-sided resinous medium is subjected to the step of fixing toner images to one (first) of the two surfaces of two-sided resinous medium—step of fixing toner images to the other (second) surface of two-sided resinous medium—step of smoothing the second surface of the two-sided resinous medium—step of preheating the first surface—step of smoothing the first surface, in the listed sequence, and then, is discharged out of the apparatus.

With the provision of the heating apparatus 120 described above, it is possible to raise the temperature of the two-sided resinous medium from roughly 50 degrees, to which it falls after the smoothing of the second surface of the two-sided resinous medium, to roughly 100 degrees. Therefore, it is possible to yield a print, the two surfaces of which are less different in glossiness than the print made with the use of the image forming apparatus in the first embodiment. That is, the smoothing apparatus in this embodiment structured as described above is superior to the smoothing apparatus in the first embodiment, in terms of the glossiness of the two surfaces of a print made using a sheet of resinous medium.

Incidentally, the further studies made by the inventors of the present invention revealed the following. That is, as long as the difference between the temperature of a sheet of two-sided resinous medium immediately before the smoothing of the first surface of the two-sided resinous medium, and that before the smoothing of the second surface, is set to a value no greater than n20 degrees, it is possible to yield a print which is no greater than 10% in terms of the glossiness difference between its front and back surfaces. In other words, it is not mandatory that the design of the smoothing apparatus is such that the above described temperature difference is zero. That is, it may be such that the above described temperature difference falls within n20 degrees.

Figure 5:
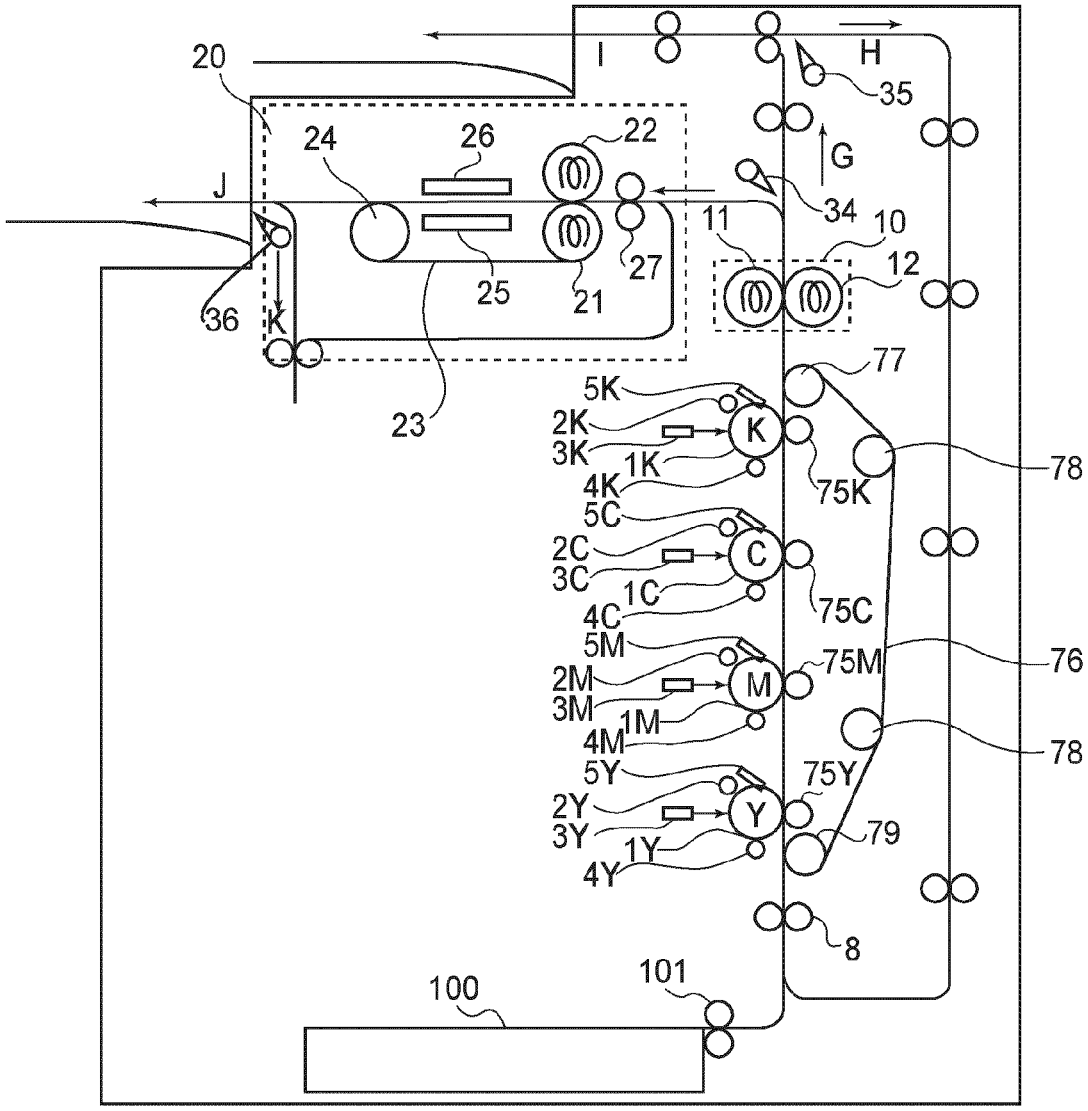
FIG. 5 is a schematic sectional view of one of the modified versions of the image forming apparatus shown in FIG. 1.

Needless to say, the smoothing apparatus in this embodiment is also compatible with the image forming apparatus shown in FIG. 5 (second embodiment).

Embodiment 4

In terms of the physical design of the smoothing apparatus, this embodiment is the same as the third embodiment. However, it is different from the third embodiment in that the conditions (heating temperature, pressure, medium conveyance speed) under which the first surface is smoothed is made different from those under which the second surface is smoothed. Otherwise, this embodiment is the same as the first embodiment.

The studies made by the inventors of the present invention revealed that after the second surface of two-sided resinous medium is smoothed, it is reduced in glossiness by the smoothing of the first surface. That is, the second surface of two-sided resinous medium, which is the first surface of the two-sided resinous medium to be smoothed, is subjected to heat and pressure while the first surface, in terms of toner image transfer, is smoothed. Therefore, it is unnecessary for the second surface to be subjected to heat and pressure during the smoothing of the first surface.

However, the amount by which heat is applied to the first surface of two-sided resinous medium to smooth the first surface is reduced to a certain value or smaller, the toner images on the first surface are not likely to be satisfactorily embedded into the toner reception layer, making it therefore unlikely for the first surface to be satisfactorily smoothed.

In this embodiment, therefore, immediately before the smoothing of the first surface of the two-sided resinous medium, the temperature of the two-sided resinous medium is raised to a level higher than that immediately before the smoothing of the second surface, with the use of the heating apparatus 120, and further, the conditions under which the first surface is smoothed are rendered lax compared to the conditions under which the second surface is smoothed. Incidentally, the conditions under which the surfaces of two-sided resinous medium are smoothed include at least one among the heating temperature (target temperature of belt), amount of pressure applied to resinous medium (nip pressure), and medium conveyance speed (surface velocity of belt) as processing speed. Thus, changing the conditions under which the two surfaces of two-sided resinous medium are smoothed means changing at least one among the above-mentioned heating temperature, pressure, and conveyance speed.

More concretely, immediately before the smoothing of the first surface of the two-sided resinous medium, the temperature of the two-sided resinous medium is raised to 110 degrees by the heating apparatus 120, and also, the speed at which the two-sided resinous medium is conveyed when its first surface is smoothed is set to 100 mm/sec, which is higher than the speed at which the two-sided resinous medium is conveyed when its second surface is smoothed, that is, 80 mm/sec.

That is, not only the speed at which the belt of the smoothing apparatus 20 is circularly moved is switched from 80 mm/sec to 100 mm/sec, but also, the peripheral velocity of the conveyance rollers with which the recording medium conveyance passage D is switched to 100 mm/sec.

With the modification of the conditions, as described above, under which the surfaces of two-sided resinous medium are smoothed, it was possible to keep the amount by which the smoothed second surface of two-sided resinous medium reduces in glossiness, below 5%.

Incidentally, in this embodiment described above, the first surface of two-sided resinous medium was made different from the second surface, in the resinous medium conveyance speed, which is one of the conditions under which the surfaces of two-sided resinous medium are smoothed. However, this embodiment is not intended to limit the present invention in scope.

For example, the smoothing apparatus may be designed so that the first surface of two-sided resinous medium is lower than the second surface, in the resinous medium conveyance speed, that is, another of the conditions under which the surfaces of the two-sided resinous medium are smoothed, or in the amount of pressure, that is, yet another of the above described conditions. Further, the smoothing apparatus may be designed so that any one or combination among the above-mentioned three parameters, that is, the conveyance speed, heating temperature, and pressure, can be altered as desired.

Further, it is needless to say that the smoothing apparatus in this embodiment is also compatible with the image forming apparatus (second embodiment) shown in FIG. 5.

Embodiment 5

In the third and fourth embodiments, the smoothing apparatus was structured so that two-sided resinous medium is preheated with the heating apparatus 120 immediately before it is smoothed across its second surface. In this embodiment, however, the smoothing apparatus is designed so that two-sided resinous medium is cooled immediately before its second surface is smoothed. Otherwise, the smoothing apparatus in this embodiment is the same in structure as that in the first embodiment, and therefore, will not be described in detail.

That is, in this embodiment, in order to yield a print, which is as small as possible in the difference in glossiness level between its front and back surfaces, when using a sheet of two-sided resinous medium, the smoothing apparatus is provided with a pair of cooling apparatuses 130 and 131 for pre-cooling the two-sided resinous medium immediately before smoothing the second surface of the two-sided resinous medium.

Figure 8:
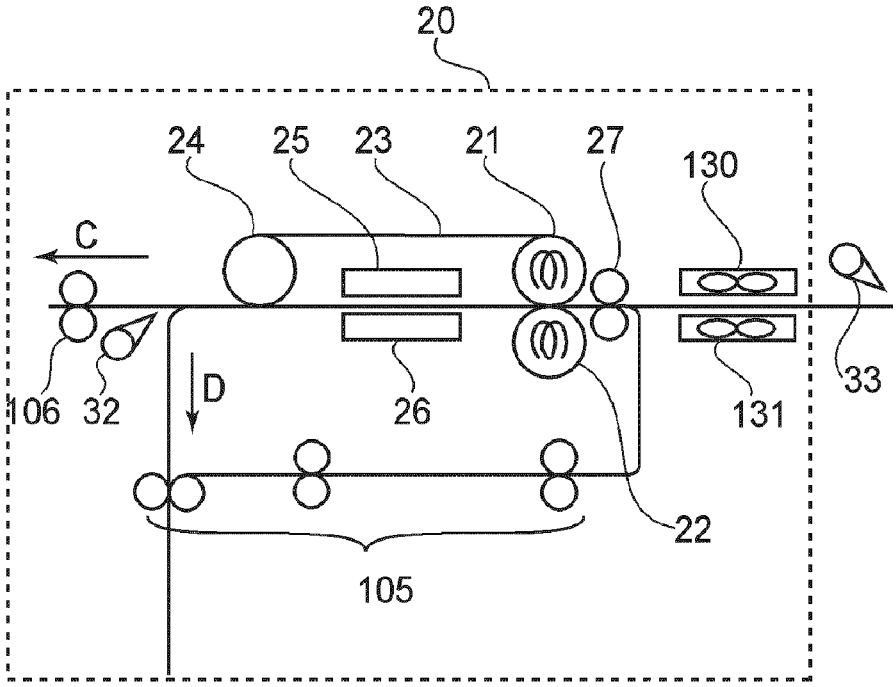
FIG. 8 is a schematic sectional view of the smoothing apparatus which pre-cools recording medium.

More concretely, referring to FIG. 8, in terms of the recording medium conveyance direction, the cooling apparatuses 130 and 131 are positioned between the fixing apparatus 10 and the pair of conveyance rollers 27. In terms of the vertical direction, they are positioned in a manner to sandwich the recording medium conveyance passage. Each of the cooling apparatuses 130 and 131 is provided with a cooling fan, and is structured so that it pre-cools two-sided resinous medium by blowing air upon the two-sided resinous medium from above and below.

As a sheet of two-sided resinous medium, which is high in temperature because it was heated by the fixing device 10, is conveyed through the portion of the recording medium conveyance passage, which are sandwiched by the cooling apparatuses 130 and 131, the cooling fans of the cooling apparatuses 130 and 131 are activated by the controller. Thus, the sheet of two-sided resinous medium is air cooled from both the front and back sides.

Next, the operation carried out by the smoothing apparatus in this embodiment, that is, the smoothing apparatus having the cooling apparatuses 130 and 131, when the image forming apparatus is in the two-sided image formation mode for two-sided resinous medium, will be described. Incidentally, the operation will be described with reference to a case in which the smoothing apparatus in this embodiment is combined with the image forming apparatus shown in FIG. 1.

The portion of the smoothing sequence up to the end of the step of fixing the toner images on the second surface of the two-sided resinous medium, that is, the step of transferring toner images onto one (first) of the two surfaces of the two-sided resinous medium—step of fixing the toner images on the first surface—step of transferring toner images onto the other (second) surface, is the same as that in the first and second embodiments described above.

In this embodiment, thereafter, the two-sided resinous medium is conveyed toward the smoothing apparatus 20 without being turned over. During this recording medium conveyance, the two-sided resinous medium is pre-cooled by the cooling apparatuses 130 and 131. After the two-sided resinous medium is introduced into the smoothing apparatus 20, its second surface is first smoothed.

Then, the two-sided resinous medium, the second surface of which has just been smoothed, is guided by the flapper 32 toward the recording medium conveyance passage D, in which it is turned over.

During this conveyance of the two-sided resinous medium to the smoothing apparatus 20 through the recording medium conveyance passage D, the two-sided resinous medium is conveyed without being cooled by the cooling apparatuses 130 and 131.

Then, after the smoothing of the first surface of the two-sided resinous medium by the smoothing apparatus 20, the two-sided resinous medium, which has been smoothed across both its surfaces, is guided by the flapper 32 toward the recording medium conveyance passage C, and then, is discharged out of the apparatus.

To summarise the above described operation, in the special two-sided image formation mode carried out by the smoothing apparatus in this embodiment, a sheet of two-sided resinous medium is subjected to the step of fixing the toner images on the first surface of the two-sided resinous medium—step of fixing the toner images on the second surface—step of pre-cooling the two-sided resinous medium—step of smoothing the second surface—step f smoothing the first surface, in the listed order, and then, is discharged out of the apparatus.

Incidentally, in consideration of the fact that, in this embodiment, immediately before the two-sided resinous medium is introduced into the smoothing apparatus 20 for the smoothing of its second surface, its temperature is lowered to 50 degrees, the recording medium conveyance speed is set to 60 mm/sec, although it was 80 mm/sec in the third embodiment.

The provision of the cooling apparatuses 130 and 131 described above made it possible to reduce the temperature of the two-sided resinous medium from roughly 100 degrees to roughly 50 degree, making it thereby possible to yield a print, which was significantly smaller in the difference in glossiness between its front and back surfaces than a print yielded by the image forming apparatus in the first embodiment. That is, this embodiment is superior to the first embodiment, in terms of the glossiness level of the two surfaces of a two-sided print produced using two-sided resinous medium.

Incidentally, it is needless to say that the smoothing apparatus in this embodiment is also compatible with the image forming apparatus (second embodiment) shown in FIG. 5.

The present invention was described with reference to the first—fifth preferred embodiments of the present invention. However, these embodiments are not intended to limit the present invention in scope. Further, this application is intended to cover such modifications or changes as may come within the purposes of the improvements or the scope of the following claims.

INDUSTRIAL APPLICABILITY

As described above, according to the present invention, it is possible to produce a highly glossy two-sided print using a sheet of recording medium having a toner reception resin layer on both of its surfaces.

While the invention has been described with reference to the structures disclosed herein, it is not confined to the details set forth and this application is intended to cover such modifications or changes as may come within the purpose of the improvements or the scope of the following claims.

The invention claimed is:

1. An image forming system comprising:

image forming device configured to form toner images on toner receiving resin layers of respective sides of a recording material;

a fixing device configured to heat-fix the toner images on the recording material in a fixing nip; and a smoothing device configured to smooth the toner receiving resin layers of the recording material having the toner images formed by said fixing means;

wherein said system is operable in an image formation mode in which the toner images formed on the respective sides of the recording material are fixed by said fixing device sequentially, and then the toner receiving resin layers of the recording material are smoothed by said smoothing device sequentially, and wherein said smoothing device includes a first rotatable member and a second rotatable member configured to form a nip for heating and pressing the toner receiving resin layer, and further includes a cooling device configured to cool the recording material moving in close contact to said first rotatable member at the toner receiving resin layer, before the recording material is separated from said first rotatable member; and a heating device configured to heat the recording material after the toner receiving resin layer is smoothed at one side of the recording material and before the toner receiving resin layer of the other side of the recording material is smoothed.

2. A system according to claim 1, further comprising a feeding path configured and positioned to reverse the recording material having been subjected to the smoothing operation of said smoothing device on one side thereof, in a facing orientation thereof, and for subsequently introducing the recording material into said smoothing device without passing through said fixing device.

3. A system according to claim 1, further comprising a feeding path configured and positioned to reverse the recording material having been subjected to the smoothing operation of said smoothing device on one side thereof, in a facing orientation thereof, and for feeding the recording material toward said image forming device, and a feeding path configured and positioned to feed the recording material having been completed in the fixing operation, toward said smoothing device without passing through said fixing device and without reversing the facing orientation.

4. A system according to claim 1, wherein said smoothing device is operable such that smoothing speed of said smoothing device is higher when the toner receiving resin layer of the other side of the recording material than when the toner receiving resin layer of said one side of the recording material.

5. A system according to claim 1, wherein said smoothing device is operable such that smoothing speed of said smoothing device is lower when the toner receiving resin layer of the other side of the recording material than when the toner receiving resin layer of said one side of the recording material.

6. A system according to claim 1, further comprising a cooling device configured to cool the recording material before the recording material having been subjected to the fixing operation of said fixing device on both sides thereof reaches the nip.

* * * * *